US006581550B2

(12) United States Patent
Shinpo et al.

(10) Patent No.: US 6,581,550 B2
(45) Date of Patent: Jun. 24, 2003

(54) COOLING STRUCTURE OF CYLINDER BLOCK

(75) Inventors: Yoshikazu Shinpo, Nissin (JP); Takashi Matsutani, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/891,402

(22) Filed: Jun. 27, 2001

(65) Prior Publication Data

US 2002/0000210 A1 Jan. 3, 2002

(30) Foreign Application Priority Data

Jun. 30, 2000 (JP) ..... 2000-197733
Jul. 11, 2000 (JP) ..... 2000-209464
Jul. 13, 2000 (JP) ..... 2000-213264

(51) Int. Cl.[7] ..... F02B 75/18
(52) U.S. Cl. ..... 123/41.74
(58) Field of Search ..... 123/41.72, 193.2, 123/41.79, 41.74, 41.28, 41.5

(56) References Cited

U.S. PATENT DOCUMENTS 4,381,736 A * 5/1983 Hirayama ..... 123/41.1
4,455,972 A * 6/1984 Kawakami ..... 123/41.29
5,233,947 A 8/1993 Abe et al.
5,386,805 A 2/1995 Abe et al.
5,842,447 A * 12/1998 Krotky et al. ..... 123/195 R
5,988,120 A * 11/1999 Betsch et al. ..... 123/41.74

FOREIGN PATENT DOCUMENTS

| | | |
|---|---|---|
| DE | 2015 948 | 10/1971 |
| DE | 24 33 813 | 6/1975 |
| GB | 1012082 | 12/1965 |
| JP | 56-012013 | 2/1981 |
| JP | 57-43338 U | 3/1982 |
| JP | A 63-272950 | 11/1988 |
| JP | 4140457 A * | 5/1992 |
| JP | A 8-296495 | 11/1996 |
| JP | A 9-68041 | 3/1997 |

* cited by examiner

*Primary Examiner*—Henry C. Yuen
*Assistant Examiner*—Hyder Ali
(74) *Attorney, Agent, or Firm*—Oliff & Berridge, PLC

(57) ABSTRACT

In a cooling structure of a cylinder block, a cooling medium is supplied into the cylinder block in which a water jacket continuously extends around a bore wall, so as to uniform the bore wall temperature. The cooling structure sets a cooling characteristic of the water jacket based on at least one of variation in the bore wall temperature in a direction perpendicular to the axis of the borehole and variation in the temperature of the cooling medium flowing around the bore wall. The structure improves the cylinder bore cooling efficiency or the cooling uniformity.

21 Claims, 28 Drawing Sheets

$Acm^2=Bcm^2=Ccm^2$

C+B=A

COOLING STRUCTURE OF CYLINDER BLOCK

The disclosure of Japanese Patent Application Nos. 2000-197733 filed on Jun. 30, 2000, 2000-209464 filed on Jul. 11, 2000 and 2000-213264 filed on Jul. 13, 2000 including the specification, drawings and abstract are incorporated herein by reference in their entirety.

BACKGROUND OF THE INVENTION

1. Field of Invention

The invention relates to a cooling structure of a cylinder block.

2. Description of Related Art

In an engine cylinder block, a water jacket is formed around a cylinder bore wall. Engine-cooling water is circulated in the water jacket to cool the cylinder bore wall heated from the combustion chambers.

In this construction, the temperature of the cylinder bore wall is unlikely to become uniform. The reason for the temperature non-uniformity is as follows. With respect to the circumferential directions relative to the cylinder bore wall, the temperature of portions in contact with two side portions of the cylinder bores in the direction of alignment of the cylinder bores where the flow speed is great is lower than the temperature of inter-cylinder bore portions where the flow stagnates. With respect to the up-down direction relative to the cylinder bore walls, the temperature of upper portions of the cylinder bore walls closer to the combustion chambers is higher than the temperature of lower portions thereof. Furthermore, with respect to the directions of alignment of the cylinder bores, the temperature becomes higher toward a downstream side.

The non-uniformity of cylinder bore wall temperature gives rise to various problems including degraded fuel economy, increased emissions of unburned hydrocarbons (HC), etc. For example, if the cylinder bore wall temperature varies in the circumferential direction, the shape of a cylinder bore wall deviates from a circular shape, thus resulting in degraded follow-up characteristics of the piston and oil rings with respect to the bore wall internal surface. If the ring tension is increased in order to prevent degradation of the follow-up characteristics, the friction in sliding movements increases, resulting in degraded fuel economy. Furthermore, if the cylinder bore wall temperature varies in the up-down direction, the evaporation and combustion of fuel deposited on an intermediate portion of each bore wall in the up-down direction deteriorates in the case of, for example, a direct fuel injection gasoline engine or the like, thus resulting in degraded fuel economy, reduced torque, and increased emission of unburned hydrocarbons (HC).

To curb these drawbacks, a uniform cylinder bore wall temperature is desired. Although there have been various proposals of improvements made regarding a water jacket of a cylinder block itself for the purpose of improving the wall temperature distribution or the like, most of them cannot be easily applied to mass production in view of productivity, mold service life, strength, etc. Some proposals have been made for improving the cylinder bore wall temperature distribution by disposing, in the water jacket of a cylinder block, a spacer (a means for uniforming the bore wall temperature by partially filling a space of the water jacket) formed separately from the cylinder block.

For example, Japanese Utility Model Application Laid-Open No. SHO 57-43338 discloses a cylinder block in which a water jacket is formed around a borehole, and a spacer whose shape is different from the shape of the water jacket in the direction of a borehole axis but is identical to the water jacket shape in the circumferential direction is disposed in the water jacket.

In this structure, a sufficient amount of cooling water is supplied around an upper portion of the borehole that is close to the combustion chamber and therefore is exposed to high temperature, and the spacer is disposed near a lower portion of the borehole that is remote from the combustion chamber and therefore is not exposed to high temperature so that supply of an unnecessary amount of cooling water is eliminated. Therefore, the structure advantageously improves the cooling water supplying efficiency.

However, the cylinder block cooling structure described in Japanese Utility Model Application Laid-Open No. SHO 57-43338 and the like has the following drawbacks.

(1) Although the bore wall near the cooling water inlet is cooled by low-temperature cooling water, the cooling water temperature increases during the passage through the surrounding of the high-temperature bore wall, so that the cooling of the bore wall becomes insufficient near the cooling water outlet. Due to the different bore wall cooling efficiencies in the bore wall circumferential direction, the borehole non-uniformly deforms. As a result, the bore wall follow-up characteristic of the piston and the like deteriorates, and the friction increases, and the fuel economy deteriorates.

(2) In a cylinder block having an open structure in which a water jacket is formed continuously around a plurality of bores, inter-bore portions receive heat transferred from the adjacent bores, but are not supplied with sufficient amounts of cooling water. Therefore, the inter-bore portions tend to have higher wall temperature than other portions. Due to the different bore wall cooling efficiencies of the inter-bore portions and the other portions, the boreholes non-uniformly deform.

SUMMARY OF THE INVENTION

It is an object of the invention to provide a cooling structure of a cylinder block capable of improving the cylinder block cooling efficiency and the cooling uniformity.

A cooling structure of a cylinder block in accordance with a first mode of the invention includes a water jacket continuously extending around a cylinder bore wall so as to convey a cooling medium, and a mechanism that sets a cooling characteristic of the water jacket based on at least one of a variation in a temperature of a cylinder bore wall in a direction perpendicular to an axis of boreholes and a variation in a temperature of the cooling medium in the direction perpendicular to the axis of boreholes, passing around the bore wall.

The setting of the cooling characteristic of the water jacket may be accomplished by disposing a spacer in the water jacket.

In the first mode, the cooling characteristic of the water jacket is set based on at least one of variation in the bore wall temperature in the direction perpendicular to an axis of the cylinder borehole and variation in the temperature of the cooling medium temperature in the direction perpendicular to an axis of the cylinder borehol passing around the bore wall. Therefore, the cylinder bore wall temperature can be uniformed by enhancing the cooling at a site of high cylinder bore wall temperature and weakening the cooling at a site of low cylinder bore wall temperature. Hence, non-uniform deformation of a borehole can be reduced.

In a cooling structure of a cylinder block in accordance with a second mode of the invention, the position of cooling around the cylinder bore is changed in accordance with the state of engine load.

According to the second mode, since the cooling position around the cylinder bore is changed in accordance with the state of engine load, it is possible to prevent a lower portion of a cylinder bore-surrounding portion from having high temperature during a high-load engine operation, by cooling the lower portion of the cylinder bore-surrounding portion during the high-load engine operation.

In a still another mode of the invention, a portion of the spacer disposed in a cooling water inlet portion or a cooling water outlet portion of the cylinder block may have a structure for reducing the flow resistance.

According to this mode, since the portion of the spacer disposed in the cooling water inlet portion or the cooling water outlet portion of the cylinder block has a structure for reducing the flow resistance, the flow resistance of inflow and outflow of the cooling water with respect to the water jacket in the cylinder block is reduced, so that the drive efficiency of a water pump will improve. Furthermore, the inflow and outflow of the cooling water with respect to the water jacket becomes smooth and stable, thus giving good effect on the cooling uniformity.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Figure 1:
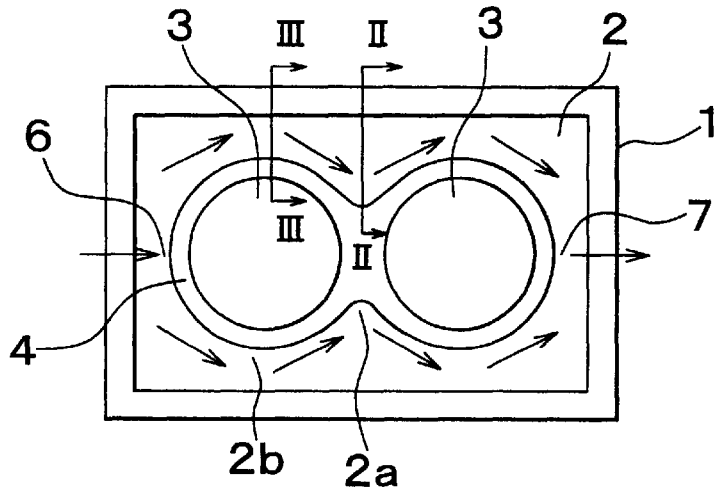
FIG. 1 is a plan view of a cylinder block cooling structure in accordance with Embodiments 1 to 7 and 43 to 54 of the invention.

Cylinder block cooling structures in accordance with embodiments of the invention will be described with reference to the accompanying drawings. In the embodiments of the invention, like component portions are represented by like reference characters in the drawings.

A cooling structure of a cylinder block will first be described with reference to, for example, FIGS. 1 to 3.

A cylinder block 1 has a cooling water inlet portion 6 and a cooling water outlet portion 7. Engine-cooling water from a water pump enters a cylinder block water jacket 2 via the cooling water inlet portion 6, and flows in a cylinder head water jacket, and flows out of the cooling water outlet portion 7. Engine-cooling water from the water pump may directly flow into the cylinder block 1, or may first flow into a cylinder head before flowing from the cylinder head into the cylinder block 1. Although in the example shown in FIG. 1, two cylinders are provided, the number of cylinders is not limited to two, but may be any number, for example, one, three, four, six, eight, etc. Although in the example of FIG. 1, the cooling water inlet portion 6 is located in a side portion of the cylinder block 1, the cooling water inlet portion 6 may be provided in an upper portion of the cylinder block 1.

A cylinder block structure 1 sets a cooling characteristic of the water jacket 2 based on at least one of variation in the bore wall temperature in the direction perpendicular to an axis of boreholes 3 and variation in the temperature of the colling medium passing around the bore wall 4. In the cylinder block structure, a spacer 5 uniforms the temperature of the wall 4 of the cylinder bores 3 by partially filling a space within the water jacket 2 so as to adjust the area on the cylinder bore wall 4 that cooling water contacts and the strength of impact of cooling water on the contact area. For example, in the vertical direction, an upper portion of the cylinder bore wall 4 tends to have a higher temperature due to heat from the combustion chamber. Therefore, an external surface of a lower portion of the cylinder bore wall 4 is covered with the spacer 5 so that cooling water selectively cools the upper portion of the cylinder bore wall 4 more strongly. In the cylinder bore circumferential direction, the spacer 5 causes a great amount of cooling water to contact an inter-cylinder bore portion, and serves to increase the flow speed. In both side portions with respect to the direction of the cylinder bore alignment, the spacer 5 serves to reduce the flow speed.

It is desirable that the spacer 5 be formed separately from the cylinder block 1, and be disposed within the water jacket 2 of the cylinder block 1. The reason for this preference is that the separate provision of the spacer 5 increases the degree of freedom in the mold construction in the casing of the cylinder block, and increases the productivity, and eliminates the adverse effect that the deformation of the cylinder block external walls caused at the time of joining the cylinder head has on the cylinder bore, and the like. However, it is also practicable to form the spacer 5 together with the cylinder block 1. The material of the spacer 5 is arbitrary, for example, a metal, a resin, a rubber, a sponge, etc. It is desirable that the material be a material that allows the spacer 5 to deform upon receiving external force and to absorb the force, in order to keep the cylinder bore free from the adverse effect of deformation of an external wall of the cylinder block when the cylinder block is firmly bolted with the cylinder head.

Constructions in accordance with Embodiments 1 to 7 of the invention in which the spacer 5 is formed separately from the cylinder block 1, and is disposed within the water jacket 2 will be described with reference to FIGS. 1 to 10. In each construction, the spacer 5 serves to uniform the bore wall temperature in the cylinder bore circumferential direction.

More specifically, in Embodiments 1 to 7, the spacer 5 has at least one of the structures in accordance with Embodiments 1 to 7.

Figure 2:
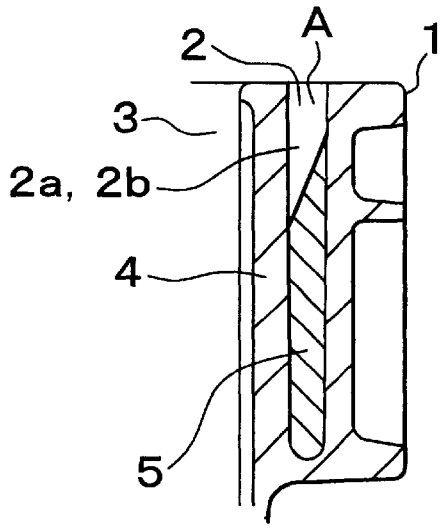
FIG. 2 is a sectional view of a portion of the cylinder block cooling structure in accordance with Embodiments 1 to 7 of the invention.
Figure 3:
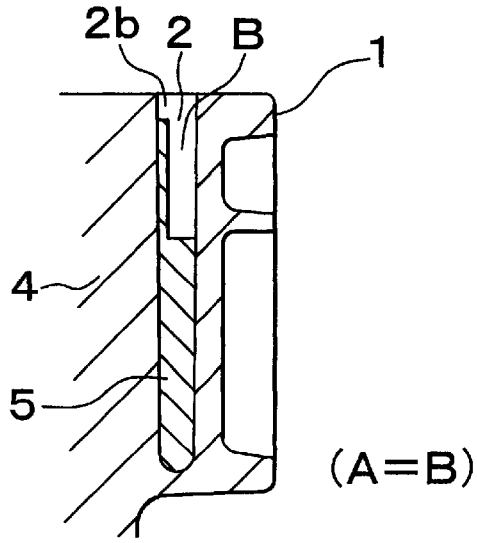
FIG. 3 is a sectional view of a thrust/counterthrust portion of the cylinder block cooling structure of Embodiment 1 of the invention.

Embodiment 1 (FIGS. 1, 2 and 3)

The cooling water-contact area of the outer peripheral surface of the cylinder bore wall is made smaller on thrust/counterthrust sides 2*b* than on an inter-bore portion 2*a*. FIG. 2 shows a section of the inter-bore portion 2*a* taken on line II—II in FIG. 1. FIG. 3 shows a section of a thrust/counterthrust side 2*b* taken on line III—III in FIG. 1. In order to avoid increases in the flow passage resistance, the passage sectional area is set substantially constant. That is, the passage sectional area A cm2 indicated in FIG. 2 is equal to or approximately equal to the passage sectional area B cm2 indicated in FIG. 3.

Figure 4:
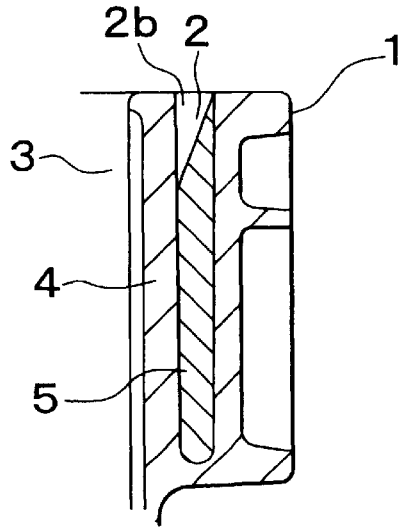
FIG. 4 is a sectional view of a thrust/counterthrust portion of the cylinder block cooling structure of Embodiment 2 of the invention.

Embodiment 2 (FIGS. 1, 2 and 4)

The cooling water passage is made narrower on the thrust/counterthrust sides 2*b* than on the side of the inter-bore portion 2*a*. FIG. 2 shows a section of the inter-bore portion 2*a*. FIG. 4 shows a section of a thrust/counterthrust side 2*b*.

Embodiment 3 (FIGS. 1, 2, 5 and 6)

Figure 5:
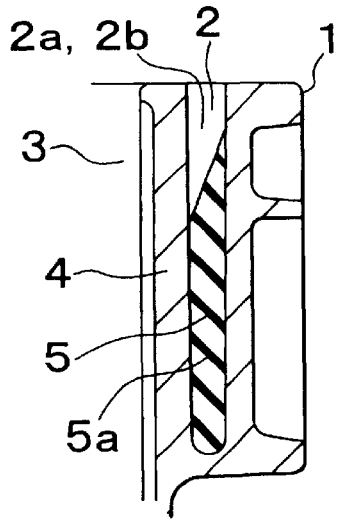
FIG. 5 is a sectional view of a thrust/counterthrust portion of the cylinder block cooling structure of Embodiment 3 of the invention, or a sectional view of an inter-bore portion of the cylinder block cooling structure of Embodiment 4 of the invention.
Figure 6:
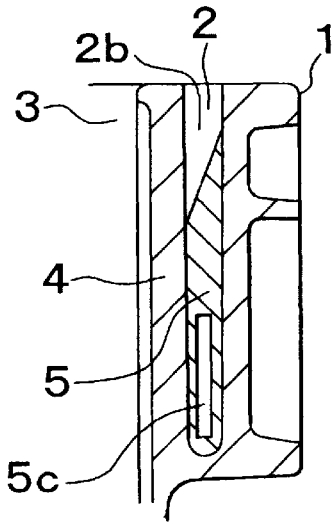
FIG. 6 is a sectional view of a thrust/counterthrust portion of the cylinder block cooling structure of Embodiment 3 of the invention.

The heat transfer rate of the spacer 5 is made lower on the thrust/counterthrust sides 2*b* than at other sites, based on material or structure. FIG. 2 shows a section of the inter-bore portion 2*a* corresponding to one of the other sites. FIG. 5 shows a section of a thrust/counterthrust side 2*b*. An example in which the heat transfer rate is reduced based on material is shown in FIG. 5. In FIG. 5, the material of the spacer 5 is, for example, a rubber or an open cell foam rubber. Low-heat transfer rate portions 5*a* of the spacer 5 are made of, for example, an isolated cell foam rubber. An example in which the heat transfer rate is reduced based on structure is shown in FIG. 6. In FIG. 6, an air layer 5*c* or an oil layer is formed in the spacer 5.

Embodiment 4 (FIGS. 1, 2, 5 and 7)

Figure 7:
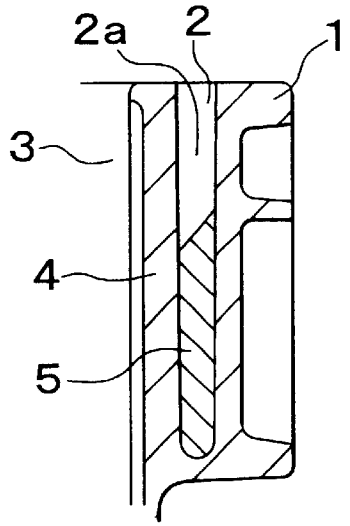
FIG. 7 is a sectional view of an inter-bore portion of the cylinder block cooling structure of Embodiment 4 of the invention.

The heat transfer rate of the spacer 5 is made higher on the side of the inter-bore portion 2*a* than at the other sites, based on material or structure. FIG. 2 shows a section of a thrust/counterthrust side 2*b*. FIG. 5 shows a section of the inter-bore portion 2*a*. An example in which the heat transfer rate is increased based on material is shown in FIG. 5. In FIG. 5, the material of the spacer 5 is a rubber or an open cell foam rubber, and high-heat transfer rate portions 5*b* of the spacer 5 are made of, for example, a metal or a resin. An example in which the heat transfer rate is increased based on structure is shown in FIG. 7. In FIG. 7, a lower portion of the water jacket is filled with a spacer 5 made of a high-heat conductivity material, so that heat is transferred from the cylinder bore wall to the cylinder block outer wall by heat conduction, and is dissipated from the outer wall.

Figure 8:
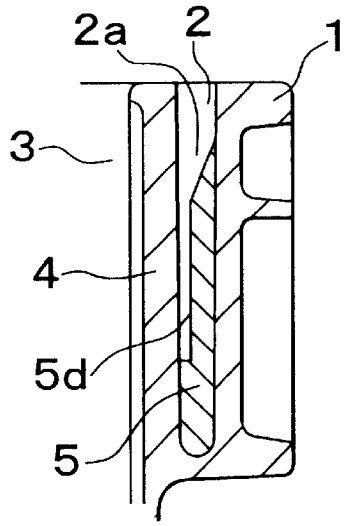
FIG. 8 is a sectional view of a high-bore wall temperature portion of the cylinder block cooling structure of Embodiment 5 of the invention.

Embodiment 5 (FIG. 1, 2 and 8)

At a cylinder bore portion with a higher wall temperature than other portions (FIG. 2), for example, at an inter-bore portion (FIG. 8), the spacer 5 has a slit 5*d* that forms a gap between the spacer 5 and the outer peripheral surface of the cylinder bore wall 4. Cooling water is passed through the slit 5*d* to cool the cylinder bore wall 4.

Figure 9:
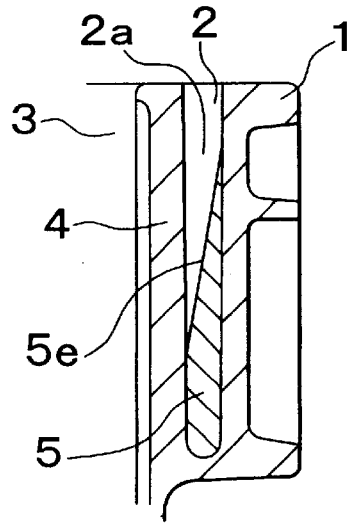
FIG. 9 is a sectional view of a high-bore wall temperature portion of the cylinder block cooling structure of Embodiment 6 of the invention.

Embodiment 6 (FIGS. 1, 2 and 9)

In a cylinder bore portion (FIG. 9) with a higher wall temperature than other portions (FIG. 2), a taper portion 5*e* of the spacer 5 is made deeper.

Figure 10:
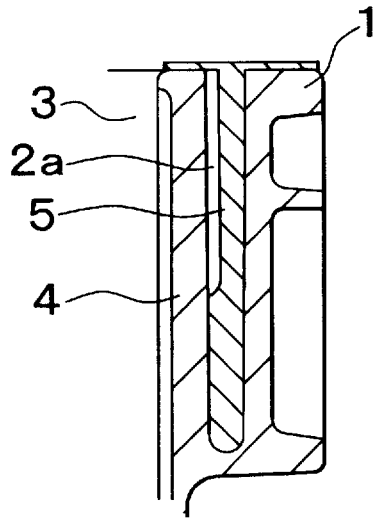
FIG. 10 is a sectional view of an inter-bore portion of the cylinder block cooling structure of Embodiment 7 of the invention.

Embodiment 7 (FIGS. 1, 2 and 10)

The passage area is constricted by the spacer 5 to increase the flow speed at the inter-bore portion (FIG. 10) in comparison with other portions (FIG. 2). The portion with an increased flow speed enjoys an increased heat transfer rate and therefore an enhanced degree of cooling.

In the cylinder block cooling structures of Embodiments 1 to 7, the cylinder bore wall temperature is uniformed in the bore circumferential direction by the spacer 5.

Cylinder block cooling structures in accordance with Embodiments 8 to 12 will be described with reference to FIGS. 11 to 18. As for a cylinder block structure, a spacer 5 is formed separately from a cylinder block 1, and is disposed within a water jacket 2. In a cylinder block art related to the invention, the temperature of cooling water increases while cooling water introduced via a cooling water inlet flows around the high-temperature bore wall. Therefore, although a portion of the bore wall near the cooling water inlet is cooled by low-temperature cooling water, the cooling of the bore wall is insufficient in the vicinity of the cooling water outlet. In embodiments of the invention, the spacer 5 has at least one of structures of Embodiments 8 to 12, so as to serve to uniform the cylinder bore wall temperature in the direction of cylinder alignment.

Embodiment 8 (FIGS. 11, 12 and 13A to 13C)

Figure 11:
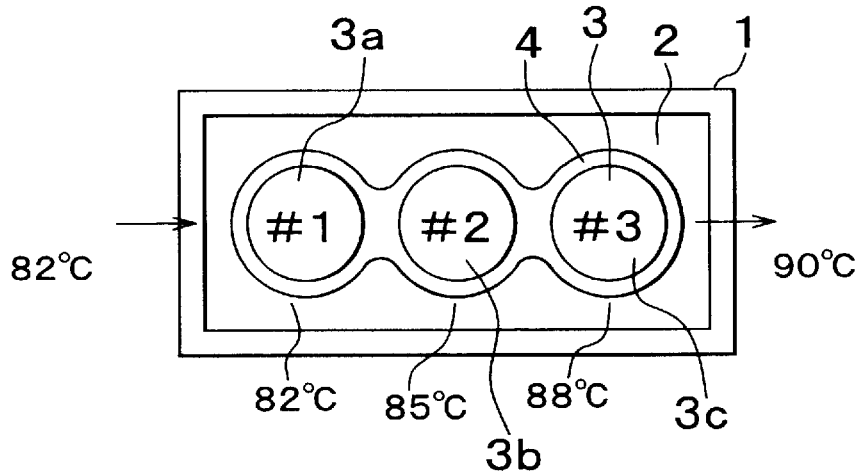
FIG. 11 is a plan view of a cylinder block cooling structure in accordance with Embodiments 8 to 12 of the invention.
Figure 13A:
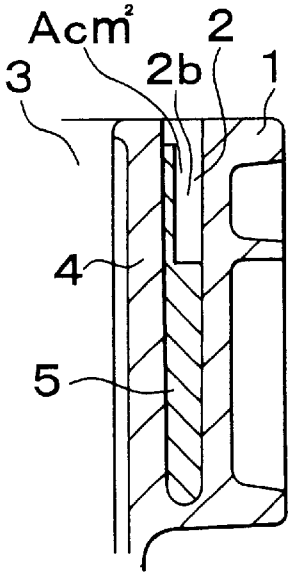
FIGS. 13A–13C show sectional views of the cylinder block cooling structure of Embodiment 8 of the invention taken at a cooling water inlet, an intermediate portion, and a cooling water outlet.
Figure 13B:
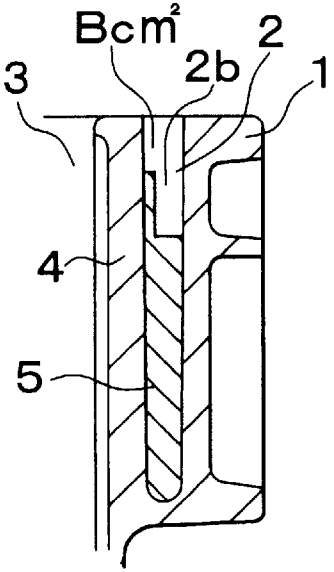
Figure 13C:
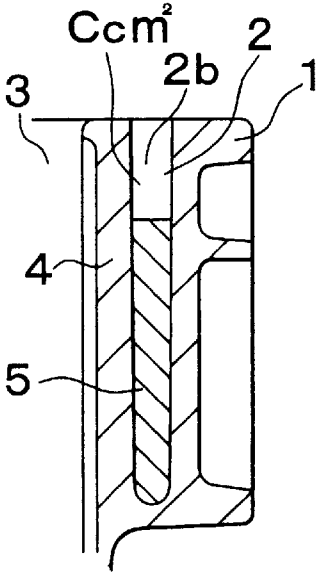

FIG. 11 shows three boreholes 3*a*, 3*b*, 3*c* disposed in a clyinder block 1. The cooling water-contact area of the outer peripheral surface of the cylinder bore wall is set to a small area near the cooling water inlet, as shown in FIG. 13A, near cylinder 3*a*, and is set to a large area near the cooling water outlet, as shown in FIG. 13C, near cylinder 3*c*. FIG. 13B shows the cooling water-contact area of the outer peripheral surface of the cylinder bore wall near cylinder 3*b*.

Embodiment 9 (FIGS. 11, 12 and 14A to 14C)

Figure 14A:
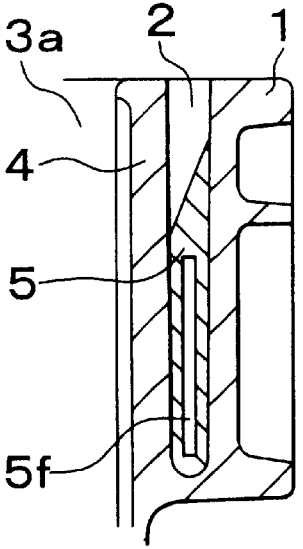
FIGS. 14A, 14B and 14C are sectional views of the cylinder block cooling structure of Embodiment 9 of the invention taken at the cooling water inlet and the cooling water outlet.
Figure 14B:
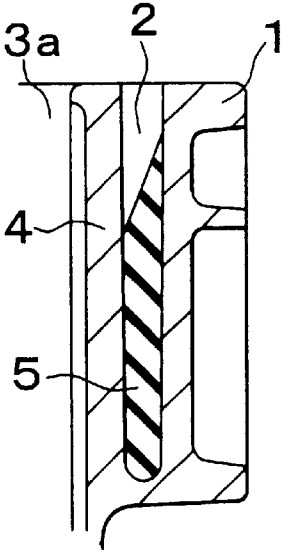
Figure 14C:
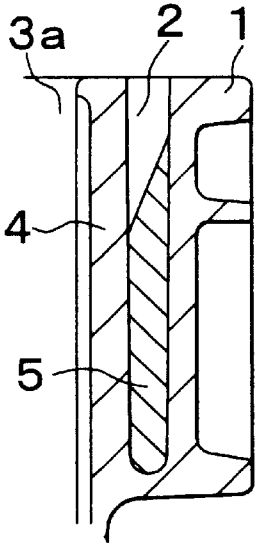

The heat transfer rate of the spacer 5 is set to a small value near the cooling water inlet, and is set to a great value near the cooling water outlet. The heat transfer rate of the spacer 5 can be reduced by forming an air layer or an oil layer 5*f* in the spacer 5 as shown in FIG. 14A, or by forming the spacer 5 from a rubber or an open cell foam rubber and providing a low-heat transfer rate material (e.g., an isolated cell foam rubber) within the spacer as shown in FIG. 14B. The heat transfer rate of the spacer 5 can be increased by forming the spacer 5 from a rubber or an open cell foam rubber, and providing a high-heat transfer rate material (e.g., a metal, a resin, etc.) on an inner surface of the space, as shown in FIG. 14C.

Figure 12:
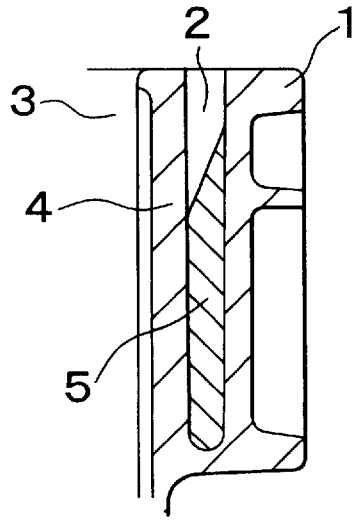
FIG. 12 is a sectional view of apportion of the cylinder block cooling structure in accordance with Embodiments 8 to 12 of the invention.

Embodiment 10 (FIGS. 11, 12 and 15)

Figure 15A:
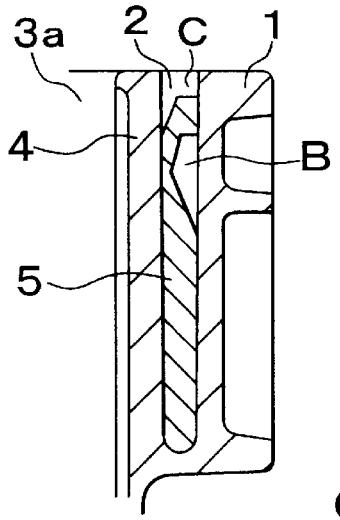
FIGS. 15A and 15B show sectional views of the cylinder block cooling structure of Embodiment 10 of the invention taken at the cooling water inlet and the cooling water outlet.
Figure 15B:
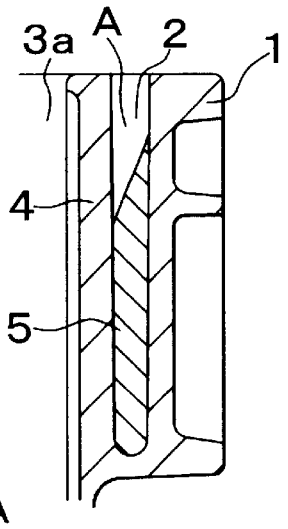

The sectional area of passage of cooling water that contacts the outer peripheral surface of the cylinder bore is made small near the cooling water inlet, as shown in FIG. 15A, and is made large near the cooling water outlet, as shown in FIG. 15B. The cooling water passage at the cooling water inlet is divided into a plurality of passages, and only some of the passages are caused to contact the outer peripheral surface of the cylinder bore. It is desirable that the sum of the sectional areas B and C of the plurality of passages be substantially equal to the sectional area A of the cooling water passage at the cooling water outlet, and increases in the flow passage resistance be avoided.

Embodiment 11 (FIGS. 11, 12, 16 and 17)

Figure 16:
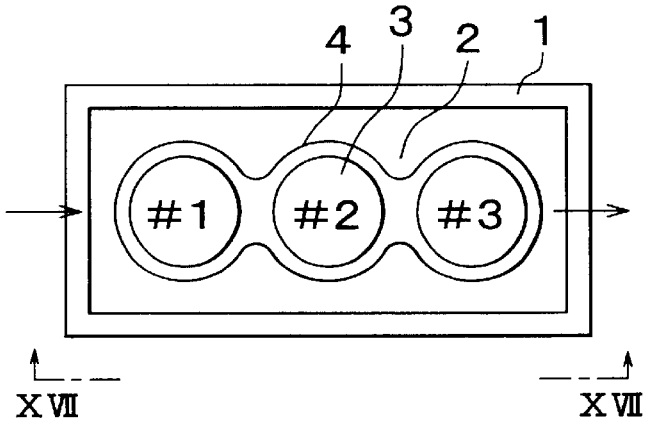
FIG. 16 is a plan view of a cylinder block cooling structure in accordance with Embodiments 11 and 12 of the invention.
Figure 17:
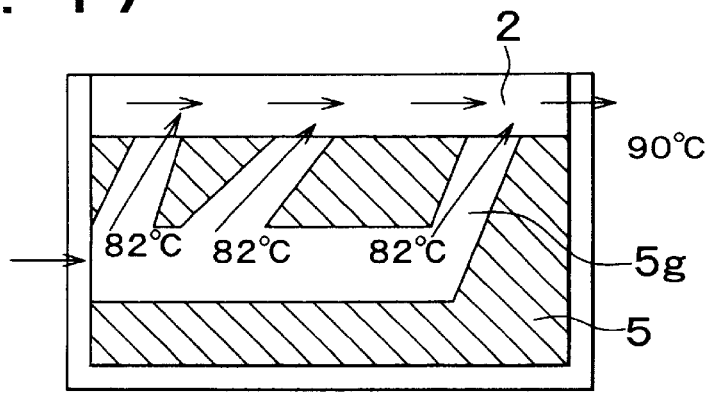
FIG. 17 is a sectional view of the cylinder block cooling structure of Embodiment 11 of the invention.

FIG. 16 is a plan view of a cylinder box where the water temperature at the inlet is 82° C., and the cooling water temperature increases while cooling water flows around the bore wall, and the cooling water temperature reaches 90° C. near the outlet. In Embodiment 11, the spacer 5 is provided with isolated channels 5*g* that lead cooling water to portions of the cylinder bore wall remote from the cooling water inlet, bypassing the water around a portion of the cylinder bore wall near the cooling water inlet, as shown in the horizontal sectional view of FIG. 17 taken on line XVII—XVII in the plan view of the cylinder box structure of FIG. 16. The channels 5*g* bring a portion of the cooling water entering via the inlet toward an outlet-side portion of the cylinder bore wall. For example, a design is made such that as shown in FIG. 16, if the inlet water temperature is 82° C. and the outlet water temperature is 90° C., cooling water having a water temperature of 82° C. is supplied toward the entire cylinder bore wall via the isolated channels 5*g*.

Figure 18:
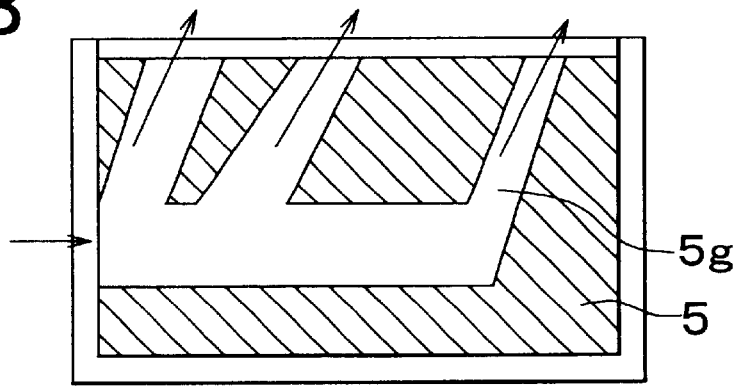
FIG. 18 is a sectional view of the cylinder block cooling structure of Embodiment 12 of the invention.

Embodiment 12 (FIGS. 11, 12 and 18)

The flow speed around the cylinder bore wall is made progressively higher with decreases in the distance to the downstream end. As for the method for increasing the flow speed, the outlets of the isolated channels 5*g* may be constricted progressively toward the downstream side as shown in FIG. 18. It is also practicable to adopt other means, for example:

- reducing the hole diameter of the head gasket progressively toward the downstream side;
- constricting holes of the cylinder head progressively toward the downstream side;
- disposing an interference plate on a tight plug at a downstream side to reduce the passage sectional area.

Figure 19:
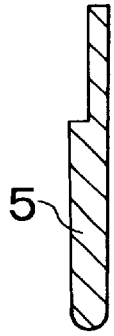
FIG. 19 is a sectional view of a cylinder block cooling structure of Embodiment 13 of the invention.
Figure 20:
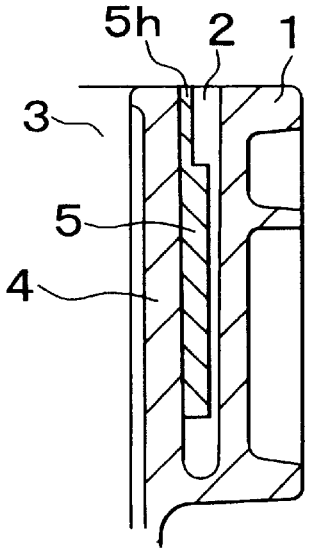
FIG. 20 is a sectional view of a cylinder block cooling structure of Embodiment 14 of the invention.

In a cylinder block cooling structure in accordance with Embodiments 13 and 14 of the invention, the spacer 5 is formed separately from the cylinder block 1, and is disposed within the water jacket 2 as shown in FIGS. 19 and 20. In embodiments of the invention, the spacer 5 has at least one of structures of Embodiments 13 and 14, and serves to uniform the cylinder bore wall temperature in the vertical direction with respect to the cylinder bores.

Embodiment 13 (FIG. 19)

The heat transfer rate of an upper portion of the spacer 5 is made greater than the heat transfer rate of a lower portion thereof.

Embodiment 14 (FIG. 20)

An upper portion of the spacer is provided with a constriction 5*h* that constricts the gap between the spacer upper portion and the outer peripheral surface of the cylinder bore wall, so that the flow speed is greater at the upper portion of the spacer than at the lower portion thereof.

In cylinder block cooling structures in accordance with Embodiments 15 to 20 of the invention, the spacer 5 is formed separately from the cylinder block 1, and a structure is provided in which the inserting load on the spacer 5 with respect to the water jacket 2 is reduced or eliminated (reduced-inserting load structure).

The reduced-inserting load structure has at least one of the structures of Embodiment 15 to 20.

Figure 21:
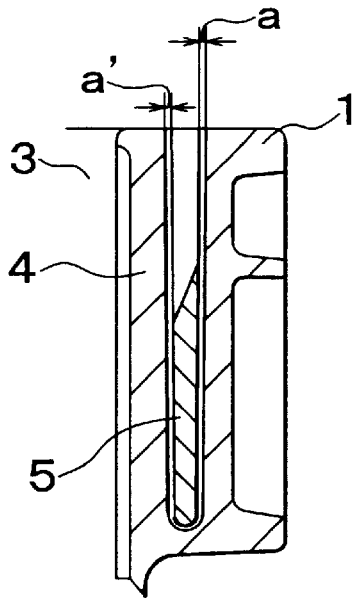
FIG. 21 is a sectional view of a cylinder block cooling structure of Embodiment 15 of the invention.

Embodiment 15 (FIG. 21)

Clearances a, a' are formed between the side surfaces of the spacer 5 and the cylinder block 1 (including the cylinder bore wall 4).

Embodiment 16

The spacer 5 is formed within the water jacket 2. For example, a foam rubber material is charged into the water jacket 2, and is formed into the spacer 5 by heating.

Embodiment 17

Only a portion of the spacer 5 is provided with a tightening margin.

Embodiment 18

A surface treatment for reducing the friction coefficient is performed on a surface of the spacer 5 that contacts the cylinder block 1.

Figure 22:
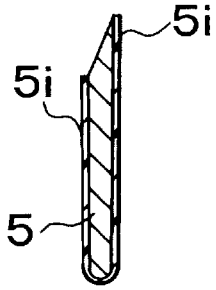
FIG. 22 is a sectional view of a cylinder block cooling structure of Embodiment 16 of the invention.

Embodiment 19 (FIG. 22)

A structure is provided in which a resin 5*i* or the like is applied onto surfaces of the spacer 5 that contact the cylinder block 1 so as to reduce the friction coefficient of the contact surfaces.

Figure 23:
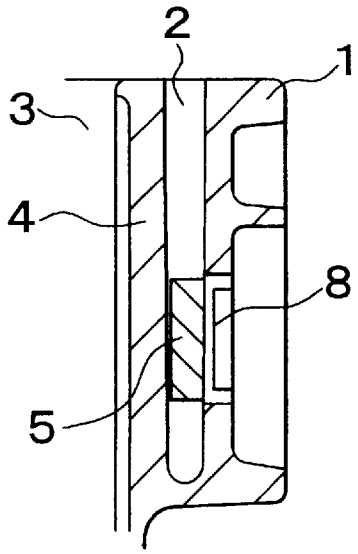
FIG. 23 is a sectional view of a cylinder block cooling structure of Embodiment 20 of the invention.

Embodiment 20 (FIG. 23)

A spacer 5 is formed on a tight plug 8 disposed in a transverse hole of the cylinder block 1. Thus, the spacer 5 is provided as a transverse insert type spacer.

In each one of the cylinder block cooling structures of Embodiments 15 to 20, the provision of a reduced-insert load structure allows smooth insertion of the spacer 5 into the water jacket 2.

In cylinder block cooling structure in accordance with Embodiments 21 to 29 of the invention, a structure is provided in which the spacer 5, formed separately from the cylinder block 1, is prevented from lifting up (an uplift preventing structure).

The uplift preventing structure adopts at least one of the structures of Embodiments 21 to 29.

Embodiment 21

The spacer 5 is made of a material that has a greater specific gravity than the liquid (water) that flows in the water jacket 2.

Figure 24:
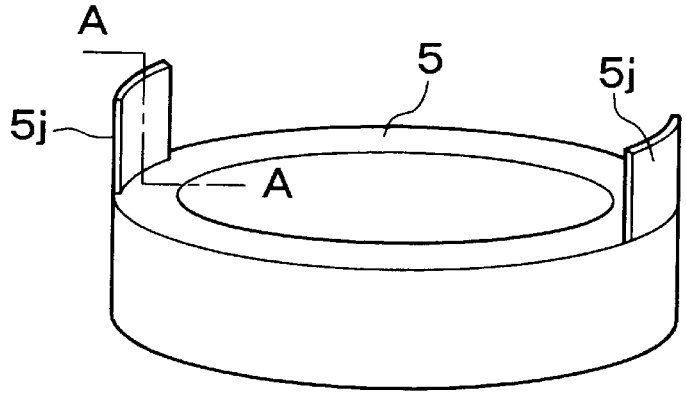
FIG. 24 is a perspective view of a cylinder block cooling structure of Embodiment 22 of the invention.
Figure 25:
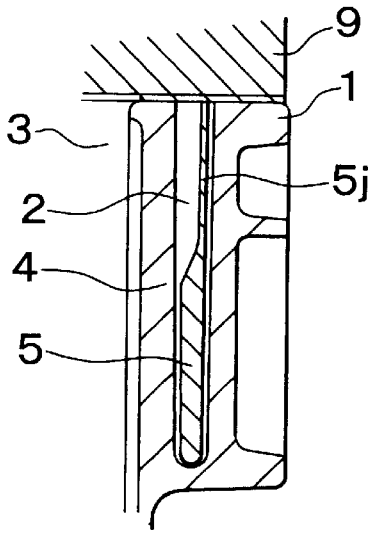
FIG. 25 is a sectional view of the cylinder block cooling structure of Embodiment 22 of the invention.

Embodiment 22 (FIGS. 24 and 25)

Posts 5*j* are provided in an upper portion of the spacer 5. The posts 5*j* are pressed from above by the cylinder 9 or the head gasket.

Figure 26:
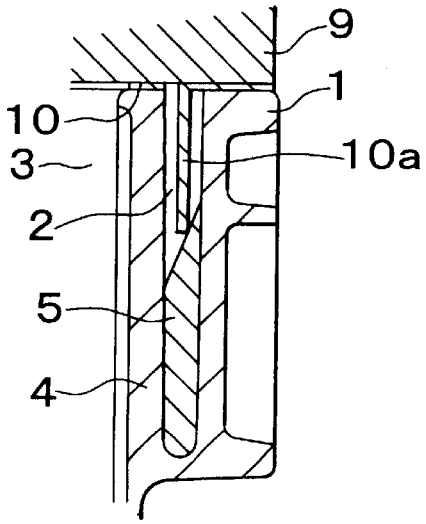
FIG. 26 is a sectional view of a cylinder block cooling structure of Embodiment 23 of the invention.

Embodiment 23 (FIG. 26)

A head gasket 10 is provided with a protrusion 10*a*. Using the protrusion 10*a*, the spacer 5 is pressed from above.

Figure 27:
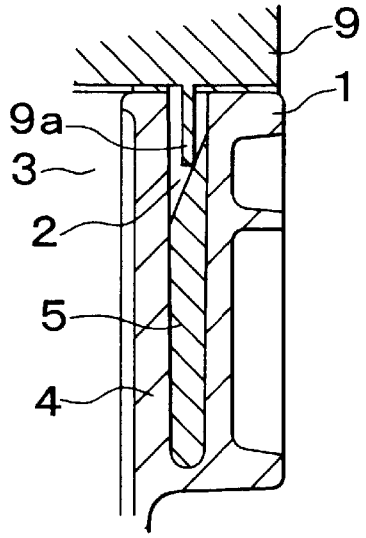
FIG. 27 is a sectional view of a cylinder block cooling structure of Embodiment 24 of the invention.

Embodiment 24 (FIG. 27)

The cylinder head 9 is provided with a protrusion 9*a*. Using the protrusion 9*a*, the spacer 5 is pressed from above.

Figure 28:
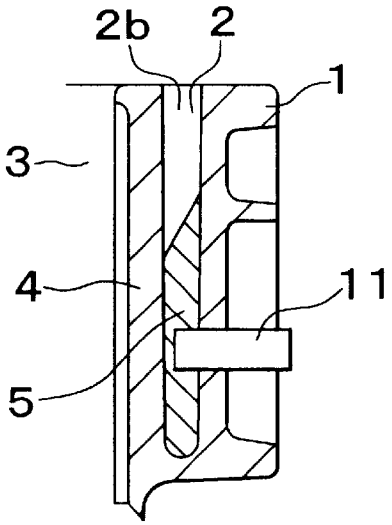
FIG. 28 is a sectional view of a cylinder block cooling structure of Embodiment 25 of the invention.

Embodiment 25 (FIG. 28)

A pin 11 is inserted from a side face of the cylinder block 1, thereby retaining the spacer 5.

Figure 29:
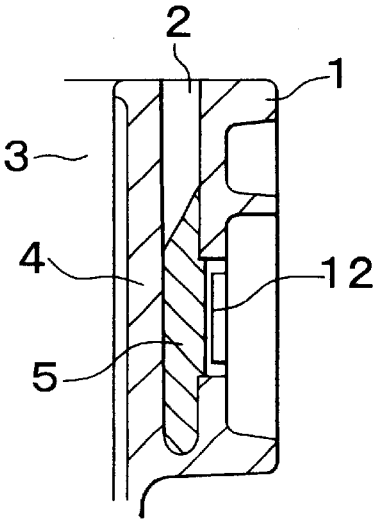
FIG. 29 is a sectional view of a cylinder block cooling structure of Embodiment 26 of the invention.

Embodiment 26 (FIG. 29)

A hole 12 is formed in a side surface of the cylinder block 1. The spacer 5 is hooked to the hole 12.

Figure 30:
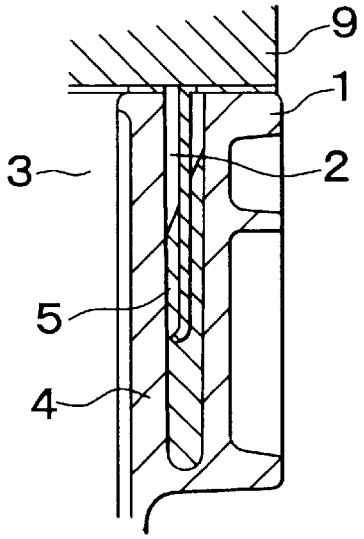
FIG. 30 is a sectional view of a cylinder block cooling structure of Embodiment 27 of the invention.

Embodiment 27 (FIG. 30)

The spacer 5 is integrated with the cylinder head 9.

Figure 31:
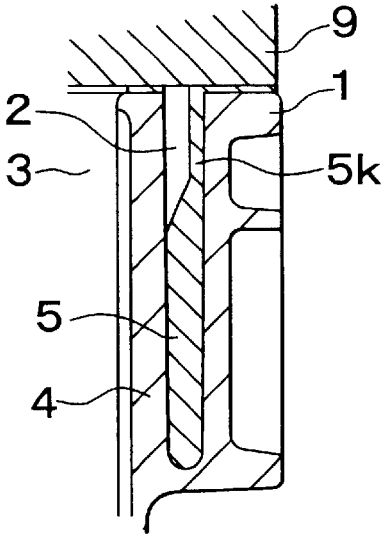
FIG. 31 is a sectional view of a cylinder block cooling structure of Embodiment 28 of the invention.

Embodiment 28 (FIG. 31)

A portion 5*k* of the spacer 5 that extends upward is clamped between the cylinder head 9 and the cylinder block 1.

Embodiment 29

The spacer 5 is adhered to a water jacket surface.

In the cylinder block cooling structures of Embodiments 21 to 29, the spacer 5, after being inserted into the water jacket 2, is prevented from ascending, due to the provision of an uplift preventing structure.

In cylinder block cooling structures in accordance with Embodiments 30 to 38 of the invention, a structure 5 in which the cooling characteristic of the water jacket 2 is set based on at least one of variation in the bore wall temperature in a direction perpendicular to an axis of a bore 3 and variation in the temperature of coolant that flows around the cylinder bore wall 4 is formed by the cylinder block 1 itself, or the spacer 5 provided within the water jacket 2 formed integrally with the cylinder block 1.

The structure 5 incorporates at least one of the structures of Embodiments 30 to 33, and serves to uniform the cylinder bore wall temperature in the cylinder bore circumferential direction.

Embodiment 30

The wall thickness of the cylinder bore wall 4 is made greater at the thrust/counterthrust sides than at the inter-bore portion.

Embodiment 31

The cooling water passage is made narrower at the thrust/counterthrust sides than at the inter-bore portion.

Embodiment 32

The heat transfer rate of the spacer at the thrust/counterthrust sides is reduced based on material or structure, in comparison with the heat transfer rate of the spacer at the inter-bore portion.

Embodiment 33

The flow passage is constricted to increase the flow speed at the inter-bore portion.

The aforementioned structure 5 incorporates at least one of the structures of Embodiments 34 to 38, and then serves to uniform the cylinder bore wall temperature in the direction of cylinder alignment.

Embodiment 34

The wall thickness of the cylinder bore wall 4 is made greater at the side of the cooling water outlet 7 than at the side of the cooling water inlet 6.

Figure 32:
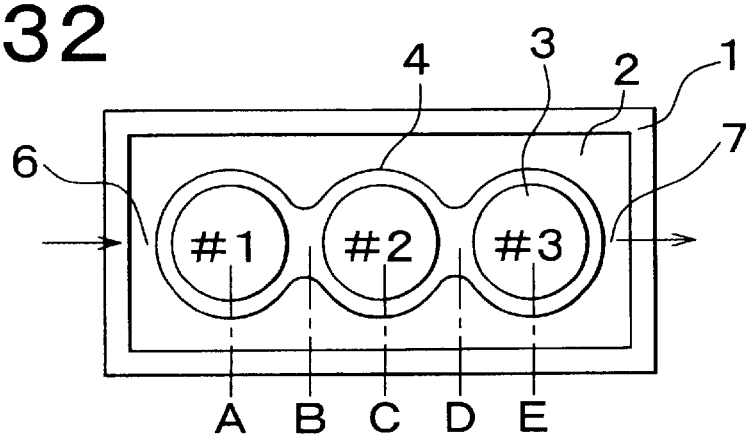
FIG. 32 is a plan view of a cylinder block cooling structure of Embodiment 35 of the invention.
Figures 33A, 33B, 33C, 33D, 33E:
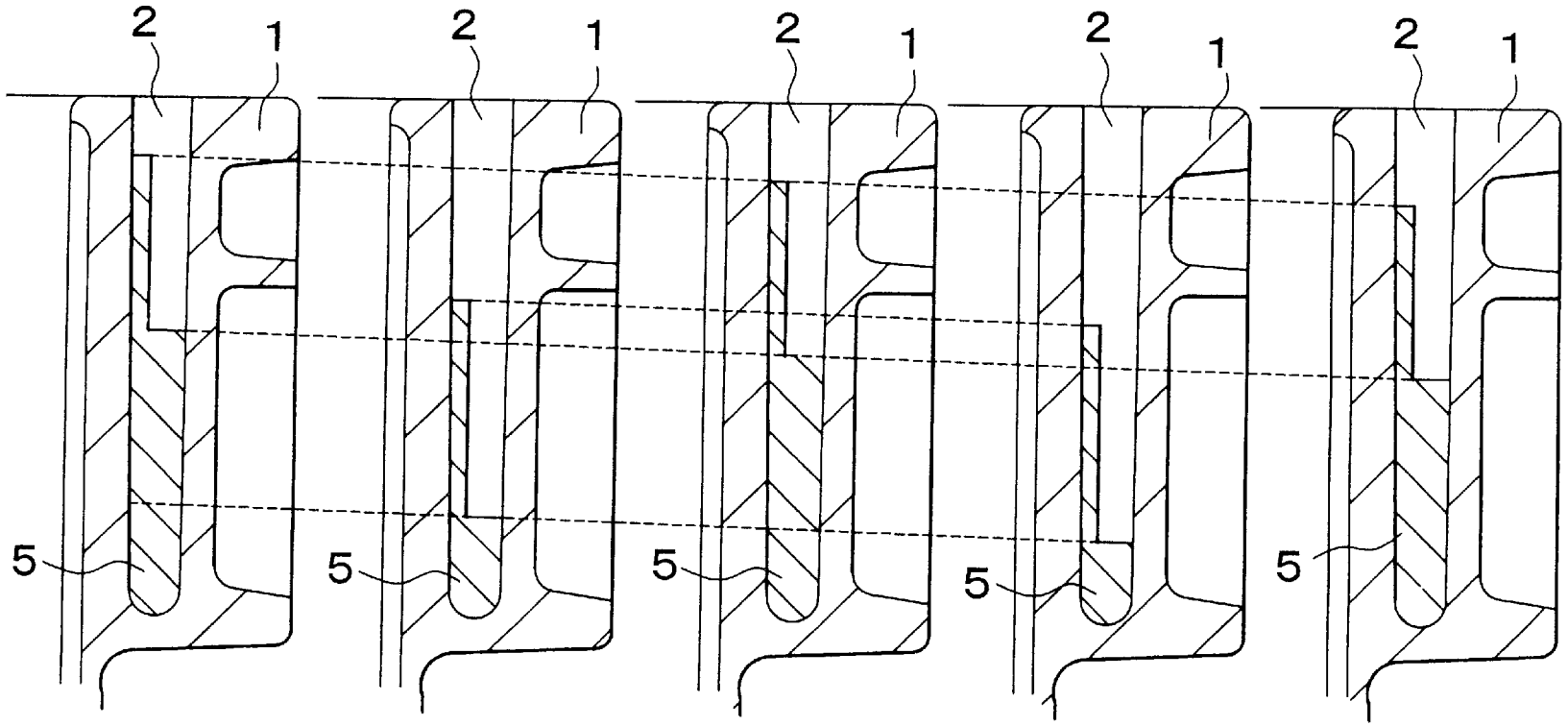
FIGS. 33A–33E show sectional views of the cylinder block cooling structure of Embodiment 35 of the invention taken at various sites.

Embodiment 35 (FIGS. 32 and 33)

The cooling water passage is expanded progressively from the side of the cooling water inlet 6 to the side of the cooling water outlet 7 so that at the thrust/counterthrust sites on the cylinder bore outer periphery, the area of the cylinder bore wall outer peripheral surface that contacts cooling water is increased progressively from the side of the cooling water inlet 6 to the side of the cooling water outlet 7. With regard to the spacer 5 formed together with the cylinder block 1, the spacer configuration is reduced progressively from the side of the cooling water inlet 6 to the side of the cooling water outlet 7, at the thrust/counterthrust sites of the cylinder bore outer periphery. Sites A, B, C, D and E in FIGS. 33A–33E correspond to sites A, B, C, D and E in FIG. 32.

Embodiment 36

A material having a higher heat transfer rate is used for the spacer at the side of the cooling water outlet 7 than at the side of the cooling water inlet 6.

Embodiment 37

The flow passage is constricted to increase the flow speed at the side of the cooling water outlet 7.

Figure 34:
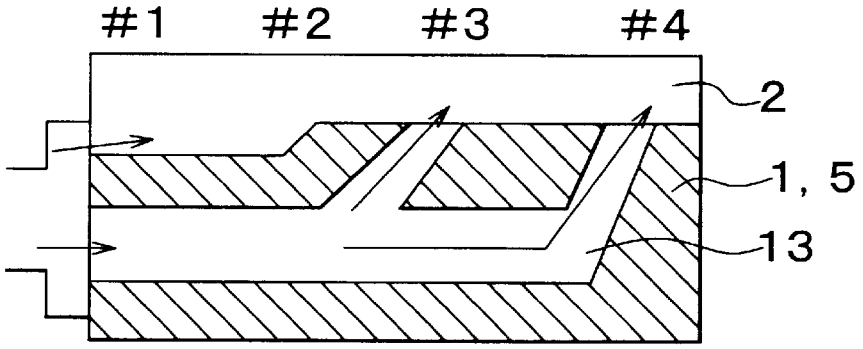
FIG. 34 is a sectional view of a cylinder block cooling structure of Embodiment 38 of the invention.

Embodiment 38 (FIG. 34)

An isolated channel 13 is formed in the cylinder block 1 or in the spacer 5 formed together with the cylinder block 1 so that the isolated channel 13 conveys cool water toward portions of the cylinder bore wall that are remote from the cooling water inlet 6.

The structure 5 incorporates at least one of the structures of Embodiments 39 to 42, and serves to uniform the cylinder bore wall temperature in the vertical direction relative to each cylinder bore.

Embodiment 39

The wall thickness of the cylinder bore wall is made greater at the side of a lower portion of each cylinder bore than at the side of an upper portion thereof.

Embodiment 40

The cooling water passage is reduced at the side of a lower portion of each cylinder bore than at the side of an upper portion thereof.

Embodiment 41

A material with a lower heat transfer rate is used for the spacer at the side of a lower portion of each cylinder bore than at the side of an upper portion thereof.

Embodiment 42

The cooling water passage located at the side of an upper portion of each cylinder bore is constricted to increase the flow speed at that location.

Figure 61:
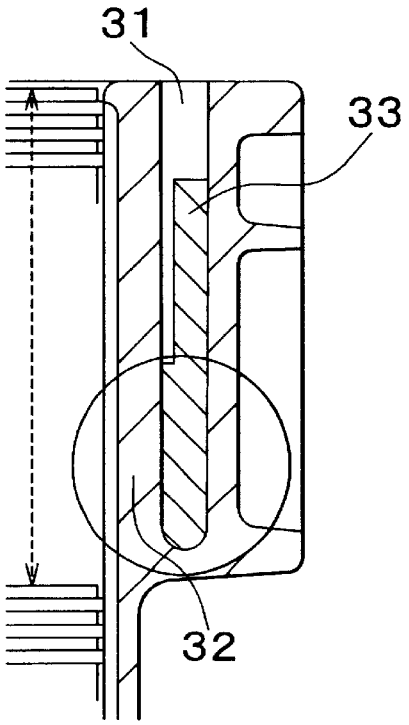
FIG. 61 RELATED ART
FIG. 61 is a sectional view of a cylinder block cooling structure in accordance with a related art.
Figure 62:
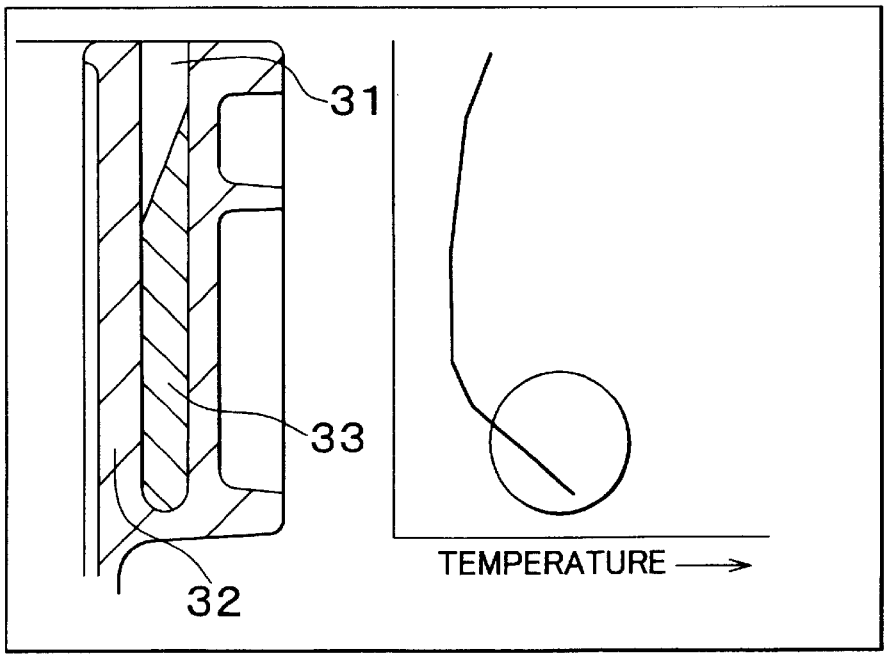
FIG. 62 RELATED ART
FIG. 62 is a sectional view of a cylinder block cooling structure in accordance with a related art, and a temperature distribution diagram thereof.
Figure 63:
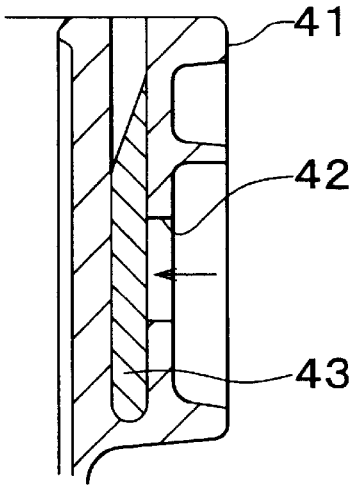
FIG. 63 RELATED ART
FIG. 63 is a sectional view of a cooling water inlet portion and its adjacent portion of a cylinder block side portion of a cylinder block cooling structure in accordance with a related art.
Figure 64:
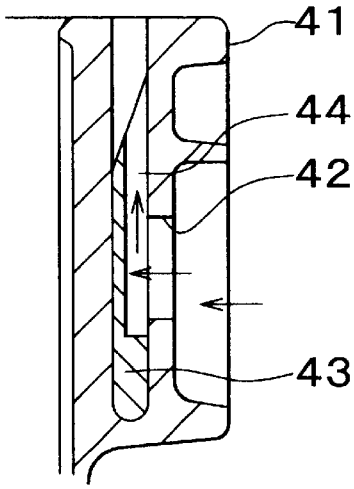
FIG. 64 RELATED ART
FIG. 64 is a sectional view of a cooling water inlet portion and its adjacent portion of a cylinder block cooling structure in accordance with a related art which has a slit.

Still further embodiments of the invention will be described below with reference to FIGS. 1, 35 and 36, In arts related to the invention as shown in FIGS. 61 and 62, the spacer is a single-stage water jacket spacer 33, and the spacer fills a lower portion of a water jacket 31. Therefore, a lower portion 32 of the cylinder bore-surrounding portion lacks cooling water, and is likely to experience insufficient cooling. During a high-load and high-speed operation of the engine, the temperature of a lower cylinder bore wall portion rises to a high temperature (at least 100° C.) due to sliding friction heat from the piston rings and the oil rings, thus leading to deteriorated oil consumption (the oil consumption deteriorates due to insufficient tensions of the piston rings and the oil rings caused by thermal expansion of the inside diameter of the bore walls) and accelerated degradation of oil (thermal degradation of oil deposited on the bore wall inner surfaces).

The aforementioned further embodiments provide cylinder block cooling structures capable of preventing high temperatures of the lower portion of the cylinder bore-surrounding portion during the high-load and high-speed ending operation. In the embodiments, the position of cooling around each cylinder bore 3 may be changed in accordance with the state of engine load as indicated in FIG. 35. In particular, when the engine load is low, an upper portion 4*a* of the cylinder bore-surrounding portion is cooled. When the engine load is high, a lower portion 4*b* of the cylinder bore-surrounding portion is cooled as well as the upper portion 4*a* thereof. The upper portion 4*a* of the cylinder bore-surrounding portion refers to a portion thereof that is above a midpoint of the piston operation range. The lower portion 4*b* of the cylinder bore-surrounding portion refers to a portion thereof that is below the midpoint of the piston operation range.

The means for cooling the lower portion of the portion surrounding the cylinder bore 3 during a high-load engine operation under a condition that the spacer 5 is set is formed by one of the following structures (1) to (5).

(1) A structure in which the lower portion of the portion surrounding the cylinder bore 3 is cooled by supplying water to the lower portion of the portion surrounding the cylinder bore 3.

(2) A structure in which the flow speed of water supplied to the lower portion of the cylinder bore 3-surrounding portion is increased to increase the degree of cooling.

(3) A structure in which the rate of heat transfer from the lower portion of the cylinder bore 3-surrounding portion to the cooling medium (cooling water, a cooling oil, external air) is raised.

(4) A structure in which the lower portion of the cylinder bore 3-surrounding portion is forcibly cooled by delivering air from outside to a portion of the cylinder block corresponding to the lower portion of the cylinder bore 3-surrounding portion.

(5) A structure in which the lower portion of the cylinder bore 3-surrounding portion is forcibly cooled by causing the engine oil to flow around the lower portion of the cylinder bore 3-surrounding portion or by splashing the engine oil to inner surfaces of the cylinder bores.

In the cylinder block cooling structures of the embodiments of the invention, the cooling position in the cylinder bore-surrounding portion is changed in accordance with the state of engine load. By cooling the lower portion 4*b* of the cylinder bore-surrounding portion during a high-load engine operation, the lower portion 4*b* of the cylinder bore-surrounding portion is prevented from having high temperature during a high-load operation.

When the engine load is low, only the upper portion 4*a* of the cylinder bore-surrounding portion is cooled (the lower portion 4*b* of the cylinder bore-surrounding portion is not particularly cooled). When the engine load is high, both the upper portion 4*a* and the lower portion 4*b* of the cylinder bore-surrounding portion are cooled. Therefore, the lower portion 4*b* of the cylinder bore-surrounding portion is prevented from having high temperature when the engine load is high.

Constructions and operations that are characteristic of individual embodiments of the invention will be described below.

Figure 35:
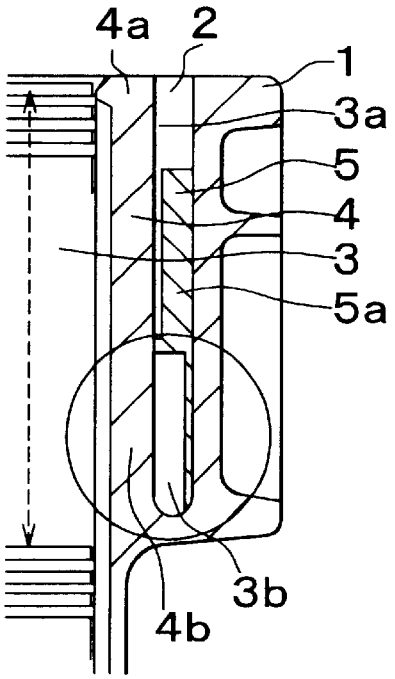
FIG. 35 is a sectional view of a cylinder block cooling structure of Embodiment 43 of the invention.
Figure 36:
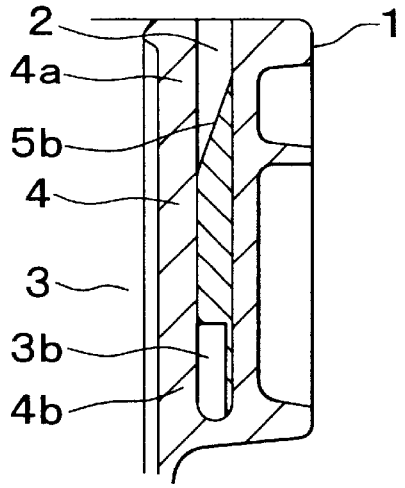
FIG. 36 is a sectional view of a cylinder block cooling structure of Embodiment 44 of the invention.
Figure 37:
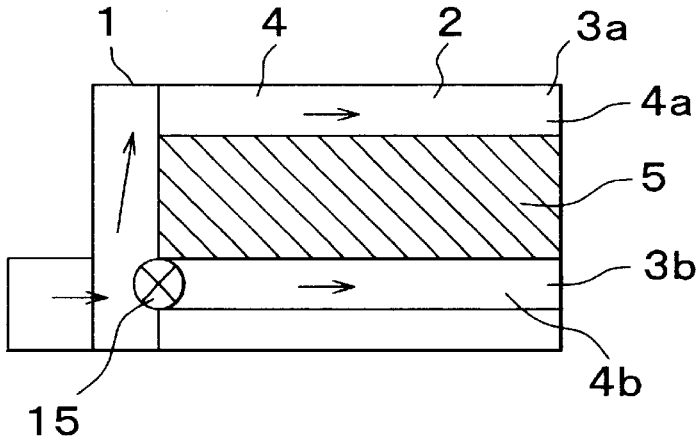
FIG. 37 is a sectional view of a cylinder block cooling structure of Embodiment 45 of the invention.

In the cylinder block cooling structures in accordance with Embodiments 43 and 44 of the invention as shown in FIGS. 1, 35 and 36, the means for cooling the lower portion 4*b* of the cylinder bore-surrounding portion during a high-load engine operation is formed by a means for water-cooling the lower portion 4*b* of the cylinder bore-surrounding portion by causing water (engine-cooling water) to flow to the lower portion 4*b* of the cylinder bore-surrounding portion.

The means for cooling the lower portion 4*b* of the cylinder bore-surrounding portion during a high-load engine operation has at least one of the structures of Embodiments 43 and 44.

Embodiment 43 (FIGS. 1 and 35)

The cooling water passage provided around a cylinder bore is a vertically two-staged cooling water passage. An upper cooling water passage 3*a* is provided above the spacer 5 in the upper portion 4*a* of the cylinder bore-surrounding portion. A lower cooling water passage 3*b* is provided in the spacer 5 (which may be formed separately from or integrally with the cylinder block 1) or in the cylinder block 1 in the lower portion 4*b* of the cylinder bore-surrounding portion, so as to water-cool the lower portion 4*b* of the cylinder bore-surrounding portion. Thus, a means for water-cooling the lower portion 4*b* of the cylinder bore-surrounding portion during a high-load engine operation is formed.

The cooling water passage 2*a* in the upper portion 4*a* of the cylinder bore-surrounding portion is formed by a passage with a stepped sectional shape which is formed by eliminating an upper portion of the spacer 5 and cutting out an upper inner peripheral portion of the spacer 5 (inner peripheral cutout 5*a*). A cooling water passage 2*b* in the lower portion 4*b* of the cylinder bore-surrounding portion is formed by eliminating a portion of the spacer extending from a lower end of the water jacket 2 to a midpoint of the piston operation range or to a position below the midpoint, or by reducing the thickness of that portion of the spacer. The lower portion 4*b* of the cylinder bore-surrounding portion is exposed to the cooling water passage 2*b*.

According to this structure, the lower portion 4*b* of the cylinder bore-surrounding portion is cooled by engine-cooling water flowing through the cooling water passage 2*b*. Thus, the lower portion 4*b* of the cylinder bore-surrounding portion is prevented from having high temperature during a high-load engine operation.

Embodiment 44 (FIGS. 1 and 36)

In Embodiment 44, the sectional shape of the cooling water passage 2*a* in the upper portion 4*a* of the cylinder bore-surrounding portion is a rectangular shape with a tapered side which is formed by providing, as an upper surface of the spacer 5, a slope 5*b* that approaches the cylinder bore wall 4 as it descends. Other constructions and operations of this embodiment are the same as or similar to those of Embodiment 1.

In cylinder block cooling structures in accordance with Embodiments 45 to 48 of the invention, the means for cooling the lower portion 4*b* of the cylinder bore-surrounding portion during a high-load engine operation is formed by a means for increasing the amount of water flowing through the lower portion 4*b* of the cylinder bore-surrounding portion during a high-load engine operation, as shown in FIG. 1 and FIGS. 37 to 40.

The means for increasing the amount of water flowing through the lower portion 4*b* of the cylinder bore-surrounding portion during a high-load engine operation has at least one of the structures of Embodiments 45 to 48.

Embodiment 45 (FIGS. 1, 35, 36 and 37)

Similar to Embodiments 43 and 44, Embodiment 45 has a vertically two-staged cooling water passage arrangement around a cylinder bore. The sectional shapes of the upper cooling water passage 3*a* and the lower cooling water passage 3*b* are identical or similar to those in Embodiments 43 and 44. Embodiment 45 has a means for increasing the amount of water flowing through the lower portion 4*b* of the cylinder bore-surrounding portion during a high-load engine operation. The means for increasing the amount of water is formed by a valve 15 that is provided in the cooling water passage 3*b* in the lower portion 4*b* of the cylinder bore-surrounding portion. The valve 15 is capable of being opened and closed. When the engine load is high, the valve 15 is opened to increase the amount of water flowing through the lower portion 4*b* of the cylinder bore-surrounding portion. When the engine load is low, the valve 15 is operated to a reduced opening (not necessarily to a completely closed state) to stop or reduce the amount of water flowing through the lower portion 4*b* of the cylinder bore-surrounding portion.

According to this structure, when the engine load is high, the valve 15 is opened to increase the amount of engine-cooling water flowing through the cooling water passage 3*b*, so that the lower portion 4*b* of the cylinder bore-surrounding portion is efficiently cooled. Thus, the structure prevents the lower portion 4*b* of the cylinder bore-surrounding portion from having high temperature during a high-load engine operation.

Figure 38:
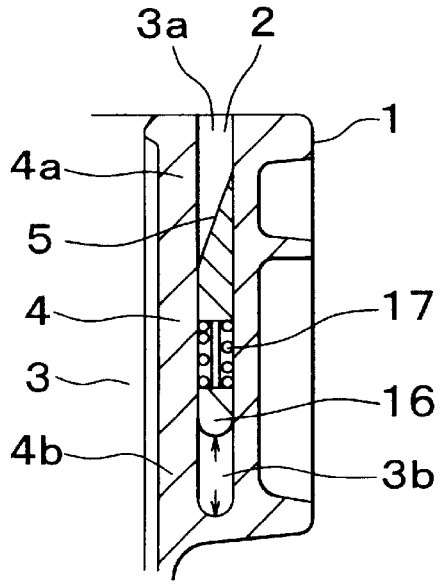
FIG. 38 is a sectional view of a cylinder block cooling structure of Embodiment 46 of the invention.

Embodiment 46 (FIGS. 1 and 38)

Embodiment 46 differs from Embodiment 45 in the structure of the means for increasing the amount of water flowing through the lower portion 4*b* of the cylinder bore-surrounding portion during a high-load engine operation. That is, the means for increasing the amount of water flowing through the lower portion 4*b* of the cylinder bore-surrounding portion during a high-load engine operation includes a valve body 16 capable of opening and closing the cooling water passage 3*b* in the lower portion 4*b* of the cylinder bore-surrounding portion, and a member 17 having an expansion-contraction function, such as a spring or the like. The amount of contraction of the member 17 is increased so as to increase the degree of opening of the valve body 16 when the water pressure on the valve body 16 increases.

During a high-load and high-speed engine operation, the operation speed of the water pump is increased to increase the water pressure, so that the degree of opening of the valve body 16 becomes great. Therefore, the amount of water flowing through the cooling water passage 3*b* in the lower portion 4*b* of the cylinder bore-surrounding portion becomes great, thereby preventing the lower portion 4*b* of the cylinder bore-surrounding portion from having high temperature during a high-load engine operation. Other constructions and operations of this embodiment are the same as or similar to those of Embodiment 45.

Figure 39:
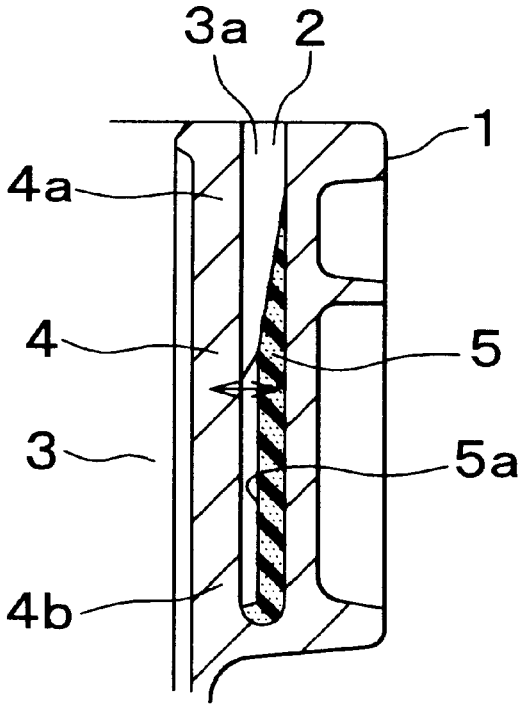
FIG. 39 is a sectional view of a cylinder block cooling structure of Embodiment 47 of the invention.

Embodiment 47 (FIGS. 1 and 39)

Embodiment 47 differs from Embodiment 45 in the structure of the means for increasing the amount of water flowing through the lower portion 4*b* of the cylinder bore-surrounding portion during a high-load engine operation. That is, the means for increasing the amount of water flowing through the lower portion 4*b* of the cylinder bore-surrounding portion during a high-load engine operation is formed by a spacer 5 formed from a material (e.g., a sponge) that has an inner periphery cutout 5*a* and contracts upon pressure.

During a high-load and high-speed engine operation, the operation speed of the water pump is increased to increase the water pressure, so that the contraction of the spacer 5 becomes great. Therefore, the amount of water flowing through the cooling water passage 3*b* in the lower portion 4*b* of the cylinder bore-surrounding portion becomes great, thereby preventing the lower portion 4*b* of the cylinder bore-surrounding portion from having high temperature during a high-load engine operation. Other constructions and operations of this embodiment are the same as or similar to those of Embodiment 45.

Figure 40:
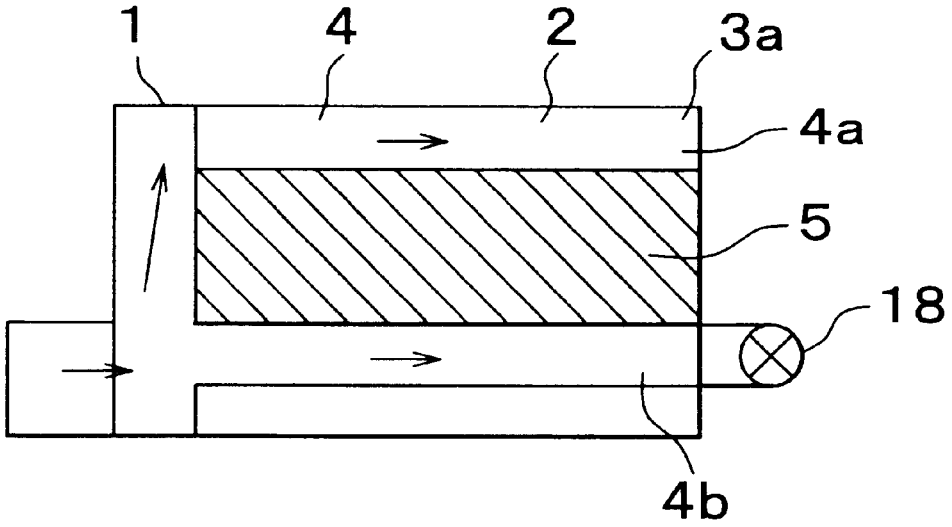
FIG. 40 is a sectional view of a cylinder block cooling structure of Embodiment 48 of the invention.

Embodiment 48 (FIGS. 1 and 40)

Embodiment 48 differs from Embodiment 45 in the structure of the means for increasing the amount of water flowing through the lower portion 4*b* of the cylinder bore-surrounding portion during a high-load engine operation. That is, the means for increasing the amount of water flowing through the lower portion 4*b* of the cylinder bore-surrounding portion during a high-load engine operation is formed by a valve 18 that is capable of opening and closing the cooling water passage in the lower portion 4*b* of the cylinder bore-surrounding portion and that is provided at a location other than the spacer 5. When the engine load is high, the valve 18 is opened to increase the amount of water flowing through the lower portion 4*b* of the cylinder bore-surrounding portion. When the engine load is low, the valve 18 is operated to a reduced opening (not necessarily to a completely closed state) to stop or reduce the amount of water flowing through the lower portion 4*b* of the cylinder bore-surrounding portion.

During a high-load and high-speed engine operation, the operation speed of the water pump is increased to increase the water pressure, so that the degree of opening of the valve 18 becomes great. Therefore, the amount of water flowing through the cooling water passage 3*b* in the lower portion 4*b* of the cylinder bore-surrounding portion becomes great, thereby preventing the lower portion 4*b* of the cylinder bore-surrounding portion from having high temperature during a high-load engine operation. Other constructions and operations of this embodiment are the same as or similar to those of Embodiment 45.

Figure 41:
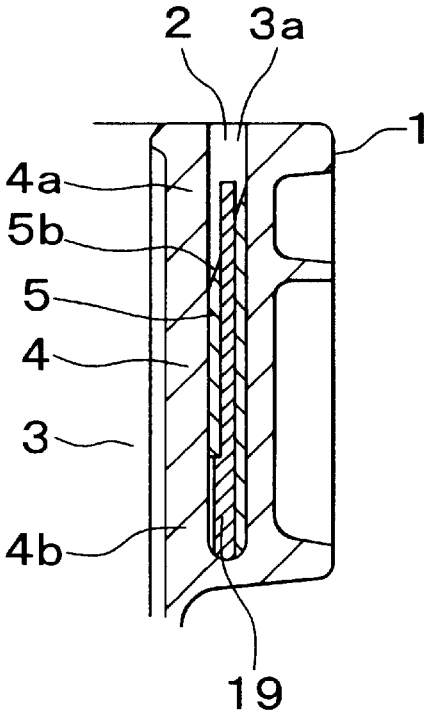
FIG. 41 is a sectional view of a cylinder block cooling structure of Embodiment 49 of the invention.
Figure 42:
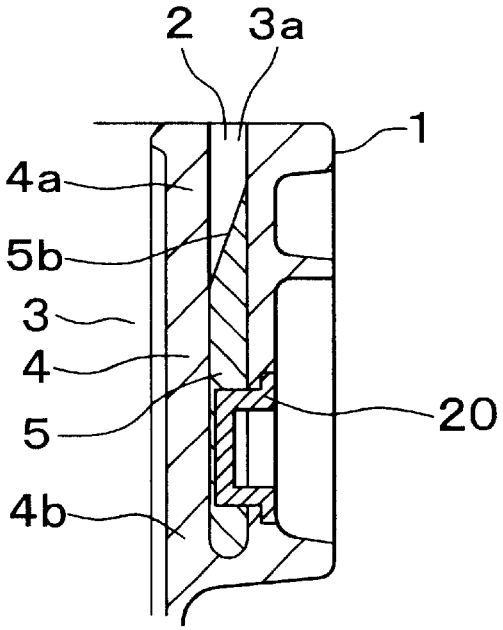
FIG. 42 is a sectional view of a cylinder block cooling structure of Embodiment 50 of the invention.

In cylinder block cooling structure in accordance with Embodiments 49 and 50 of the invention, as shown in FIGS. 41 and 42, the means for cooling the lower portion 4*b* of the cylinder bore-surrounding portion during a high-load engine operation is formed by a means for raising the heat transfer rate of the lower portion 4*b* of the cylinder bore-surrounding portion during a high-load engine operation and, more specifically, by a bimetal 19, 20 that includes a material (e.g., copper) having a higher heat conductivity than the cylinder block material and that is provided in the lower portion 4*b* of the cylinder bore-surrounding portion and that contacts the cylinder bore wall during a high-load engine operation.

The bimetal 19, 20 that contacts the cylinder bore wall during a high-load engine operation has at least one of the structures of Embodiments 49 and 50 described below.

Embodiment 49 (FIGS. 1 and 41)

A cooling water passage 3*a* is formed in the upper portion 4*a* of the cylinder bore-surrounding portion. The cooling water passage 3*a* is formed by a passage in a stepped sectional shape which is formed by eliminating an upper portion of the spacer 5 and cutting out an inner peripheral portion of the spacer 5, or by a passage in a rectangular sectional shape having a tapered side which is formed by providing as an upper surface of the spacer 5 a slope 5*b* that descends as it approaches the cylinder bore wall 4. A lower cooling water passage 3*b* is not provided. A lower portion of the spacer 5 is cut out, and a bimetal 19 is provided in the cutout. The bimetal 19 remains off the outer peripheral surface of the cylinder bore wall during a low-load engine operation. When the engine load becomes high, that is, when the cylinder bore wall temperature becomes high, the bimetal 19 firmly contacts the outer peripheral surface of the cylinder bore wall, so as to transfer heat from the cylinder bore wall to the cooling water passage 3*a* in the upper portion 4*a* of the cylinder bore-surrounding portion by heat conduction, thereby dissipating heat into the cooling water.

Thus, the lower portion 4*b* of the cylinder bore-surrounding portion is prevented from having high temperature during a high-load engine operation.

Embodiment 50 (FIGS. 1 and 42)

In Embodiment 50, a cooling water passage having a sectional shape that is identical or similar to that in Embodiment 49 is formed in the upper portion 4*a* of the cylinder bore-surrounding portion. A lower cooling water passage 3*b* is not provided. A lower portion of the spacer 5 is cut out, and a bimetal 20 that also functions as a tight plug is provided in the cutout in the lower portion of the spacer 5. The bimetal 20 remains off the outer peripheral surface of the cylinder bore wall during a low-load engine operation. When the engine load becomes high, that is, when the cylinder bore wall temperature becomes high, the bimetal 20 firmly contacts the outer peripheral surface of the cylinder bore wall, so as to transfer heat from the cylinder bore wall by heat conduction and thereby dissipate heat into external air.

Thus, the lower portion 4*b* of the cylinder bore-surrounding portion is prevented from having high temperature during a high-load engine operation.

Figure 43:
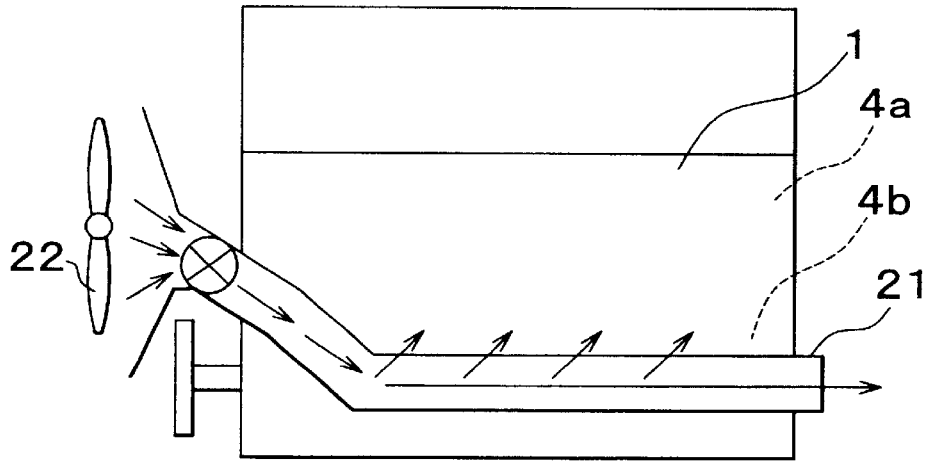
FIG. 43 is a sectional view of a cylinder block cooling structure of Embodiment 51 of the invention.

Embodiment 51 (FIGS. 1 and 43)

In the cylinder block cooling structure of Embodiment 51 of the invention, the means for cooling the lower portion 4*b* of the cylinder bore-surrounding portion during a high-load engine operation is formed by a means for air-cooling the lower portion 4*b* of the cylinder bore-surrounding portion during a high-load engine operation.

The means for air-cooling the lower portion 4*b* of the cylinder bore-surrounding portion during a high-load engine operation includes an air duct 21 provided outside a cylinder block portion for cooling the cylinder block portion, and an electric fan 22 for delivering air into the air duct 21. The electric fan 22 is connected to the engine via a coupling in such a manner that the electric fan 22 can be turned on and off. The revolution speed of the electric fan 22 is linked with the engine revolution speed.

As for the operation of the means, at the time of a high engine load, the coupling is turned on so that the electric fan 22 operates in accordance with the engine revolution. Air is thus delivered into the air duct 21, and air is blown from nozzles formed in the air duct 21 to a cylinder block portion of the lower portion 4*b* of the cylinder bore-surrounding portion. Thus, the lower portion 4*b* of the cylinder bore-surrounding portion is prevented from having high temperature during a high-load engine operation.

Figure 44:
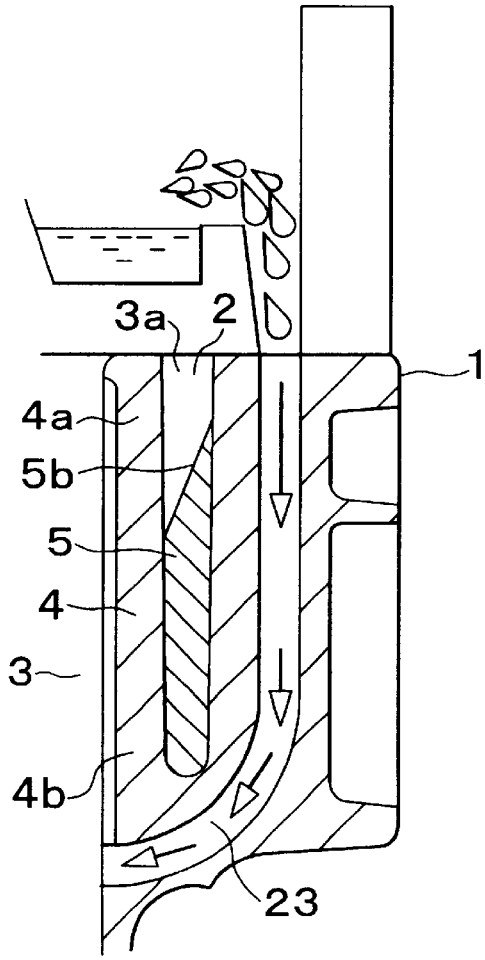
FIG. 44 is a sectional view of a cylinder block cooling structure of Embodiment 52 of the invention.
Figure 45:
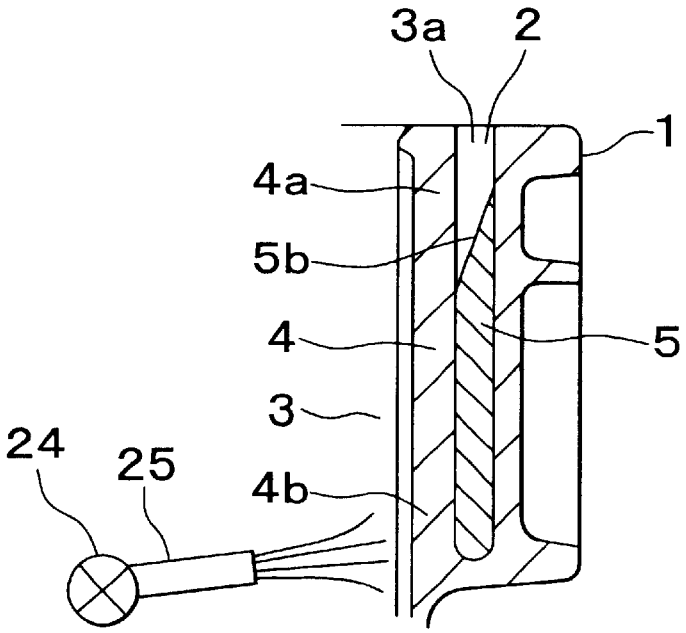
FIG. 45 is a sectional view of a cylinder block cooling structure of Embodiment 53 of the invention.
Figure 46:
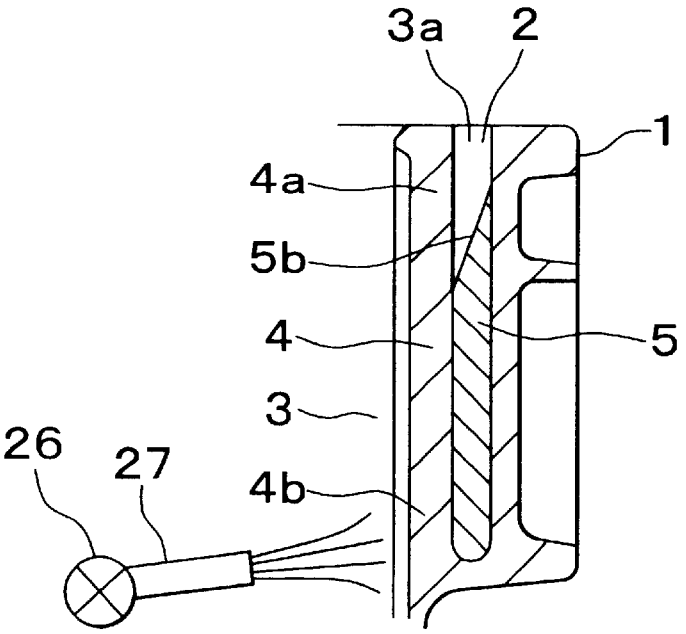
FIG. 46 is a sectional view of a cylinder block cooling structure of Embodiment 54 of the invention.

In cylinder block cooling structures in accordance with the invention, means for cooling the lower portion 4*b* of the cylinder bore-surrounding portion via an engine oil during a high-load engine operation has at least one of structures in accordance with Embodiments 52 to 54, and cools the lower portion 4*b* of the cylinder bore-surrounding portion during a high-load engine operation as indicated in FIGS. 44, 45 and 46.

Embodiment 52 (FIGS. 1 and 44)

In Embodiment 52, a cooling water passage 3*a* having a sectional shape that is identical or similar to that in Embodiment 49 is formed in the upper portion 4*a* of the cylinder bore-surrounding portion. A lower cooling water passage 3*b* is not provided. In the lower portion 4*b* of the cylinder bore-surrounding portion, an oil passage 23 that also functions as an oil fall hole passage is formed in the cylinder block 1. The means for cooling the lower portion 4*b* of the cylinder bore-surrounding portion via the engine oil during a high-load engine operation is formed by the oil passage 23.

According to this structure, during a high-load engine operation, the engine oil from the cylinder head flows down to the oil pan via the oil passage 23, so that the lower portion 4*b* of the cylinder bore-surrounding portion is cooled by the engine oil. Thus, the lower portion 4*b* of the cylinder bore-surrounding portion is prevented from having high temperature during a high-load engine operation.

Embodiment 53 (FIGS. 1 and 45)

In Embodiment 53, a cooling water passage 3*a* having a sectional shape that is identical or similar to that in Embodiment 49 is formed in the upper portion 4*a* of the cylinder bore-surrounding portion. A lower cooling water passage 3*b* is not provided. At the lower cylinder bore portion, a nozzle 25 connected to an oil pump relief valve 24 that is operated in association with engine revolution is provided. The means for cooling the lower portion 4*b* of the cylinder bore-surrounding portion via the engine oil during a high-load engine operation includes the valve 24 and the nozzle 25.

Therefore, during a high-load engine operation, the oil relieved from the oil pump relief valve 24 is ejected from the nozzle 25 and is splashed to the cylinder bore inner surface, so that the lower portion 4*b* of the cylinder bore-surrounding portion is cooled by the engine oil.

Embodiment 54 (FIGS. 1 and 46)

Embodiment 54 differs from Embodiment 53 in the means for cooling the lower portion 4*b* of the cylinder bore-surrounding portion via the engine oil during a high-load engine operation.

In Embodiment 54, a nozzle 27 is connected to a valve 26 provided in an oil passage in a lower cylinder bore portion. The means for cooling the lower portion 4*b* of the cylinder bore-surrounding portion via the engine oil during a high-load engine operation includes the valve 26 and the nozzle 27.

Therefore, during a high-load engine operation, the valve 26 is opened to eject the oil from the nozzle 27. The oil is splashed onto the inner surface of the lower cylinder bore portion, so that the lower portion 4*b* of the cylinder bore-surrounding portion is cooled via the engine oil. Therefore, the lower portion 4*b* of the cylinder bore-surrounding portion is prevented from having high temperature during an high-load engine operation. Other constructions and operations of the embodiment are the same as or similar to those of Embodiment 53.

Still further embodiments of the invention will be described with reference to FIGS. 47 to 70.

Figure 65:
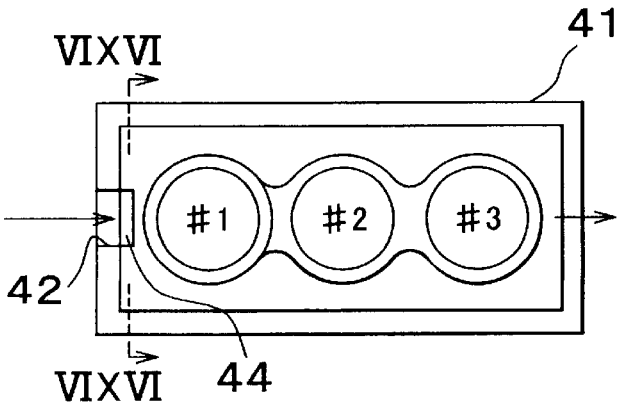
FIG. 65 RELATED ART
FIG. 65 is a plan view of a cylinder block cooling structure in accordance with a related art.
Figure 66:
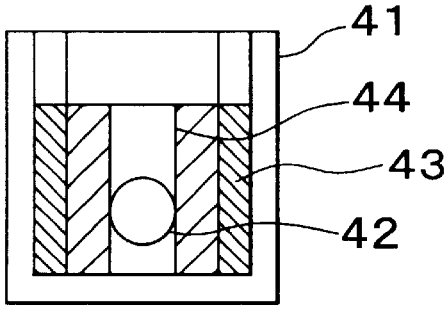
FIG. 66 RELATED ART
FIG. 66 is a sectional view of a cylinder block cooling structure in accordance with a related art (a section taken on line VIXVI—VIXVI in FIG. 65)

In an art related to the invention in which a cooling water inlet 42 (or outlet) is provided in a lower portion of a side portion of a cylinder block 41, a spacer 43 is provided substantially closing the inlet 42. In this structure, therefore, cooling water does not easily enter the cylinder block 41. FIG. 65 shows a plan view of a cylinder block structure in accordance with a related art. FIG. 66 is a section taken on line VIXVI—VIXVI in FIG. 65. If the spacer 43 is provided with a slit structure 44 as shown in FIGS. 63 to 66, the water pass resistance is considerably great and the operation efficiency of the water pump is low. Furthermore, the flow is likely to become biased, and the uniformity in cooling deteriorates.

Figure 67:
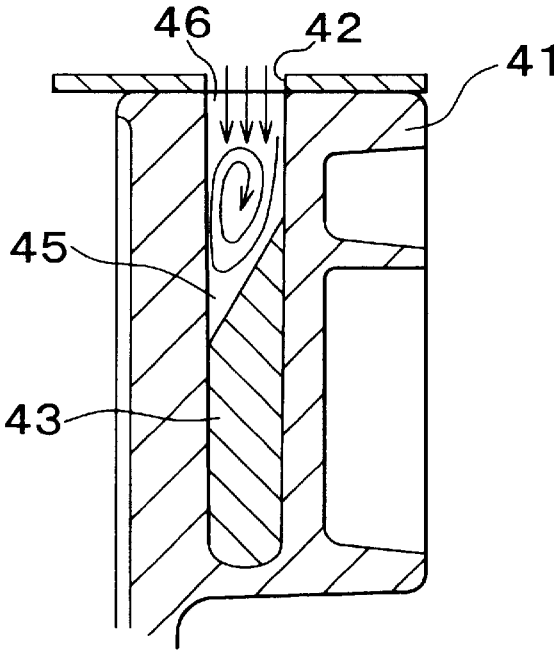
FIG. 67 RELATED ART
FIG. 67 is a cooling water inlet portion and its adjacent portion in a cylinder bore upper portion of cylinder block cooling structure in accordance with a related art.
Figure 68:
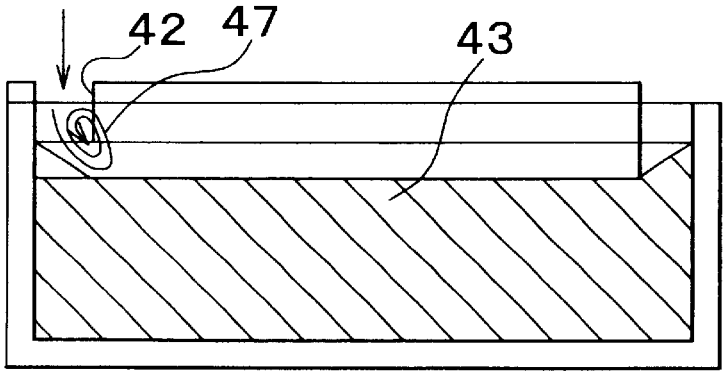
FIG. 68 RELATED ART
FIG. 68 is a longitudinal sectional view of a cylinder block including a cooling water inlet portion in a cylinder block upper portion in a cylinder block cooling structure in accordance with a related art.

In an art as shown in FIG. 67 in which a cooling water inlet 42 is formed in a cylinder block 41 and therefore cooling water flows into a water jacket 45 from above, the presence of a spacer 43 reduces the distance from the inlet 42 to the spacer 43, so that cooling water 46 doest not readily flow in. Thus, the flow passage resistance is considerably great, and the drive efficiency of the water pump is reduced. Furthermore, as shown in FIG. 68, eddies 47 are formed immediately downstream of the inlet 42. This unsmoothed flow is likely to result in biased flow and therefore degrades the cooling uniformity.

Figure 69:
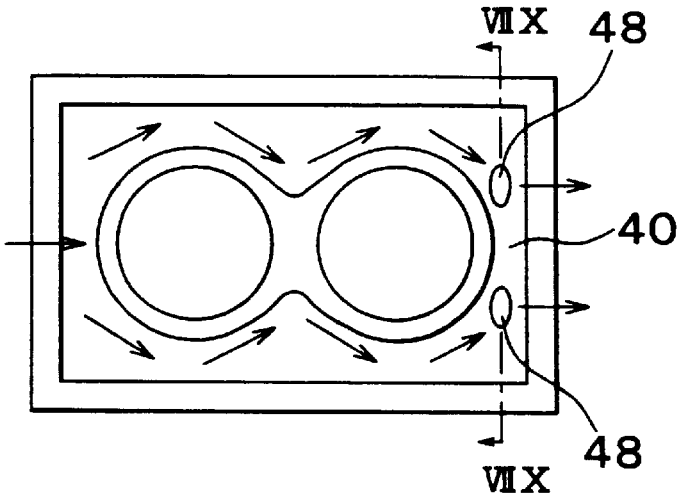
FIG. 69 RELATED ART
FIG. 69 is a plan view of a cylinder block cooling structure in accordance with a related art, including a cooling structure outlet portion.
Figure 70:
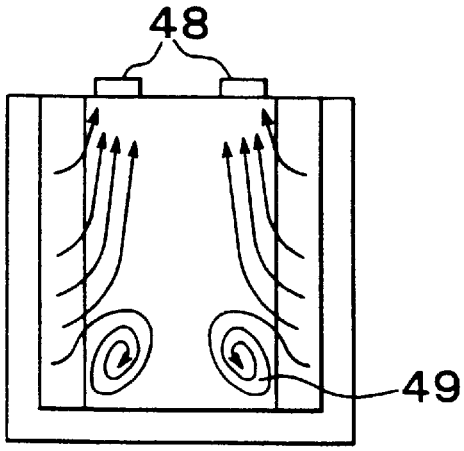
FIG. 70 RELATED ART
FIG. 70 is a sectional view of a cylinder block cooling structure in accordance with a related art, including a cooling water outlet portion (a section taken on line VIIX—VIIX in FIG. 69).

FIG. 69 shows a plan view of a related-art cylinder block structure. FIG. 70 shows a section taken on line VIIX—VIIX in FIG. 69. As for cooling water outlets 48, as shown in FIGS. 69 and 70, streams of cooling water flowing along two sides of the line of cylinder bores form a confluent portion 40. In the confluent portion 40, streams collide, forming a stagnation portion 49. Due to this unsmoothed flow, the water pass resistance is great, and the drive efficiency of the water pump is reduced.

As yet further embodiments of the invention, cylinder block cooling structures capable of reducing the water pass resistance and improving the cooling uniformity are provided. As shown in FIGS. 47 to 51, it is practicable to adopt a structure in which a spacer portion 5*a* disposed at a cooling water inlet portion 6 or a cooling water outlet portion 7 in the cylinder block 1 achieves a reduced flow resistance in comparison with the related-art structures shown in FIGS. 63 to 70. Due to the structure in accordance with embodiments, the flow resistance related to the inflow and outflow of cooling water with respect to the water jacket 2 formed in the cylinder block is reduced, so that the drive efficiency of the water pump rises and the fuel economy improves. Furthermore, the inflow and outflow of cooling water with respect to the water jacket 2 becomes smooth and stable, thereby achieving good effect on the cooling uniformity regarding the cylinder bore wall 4.

Figure 49:
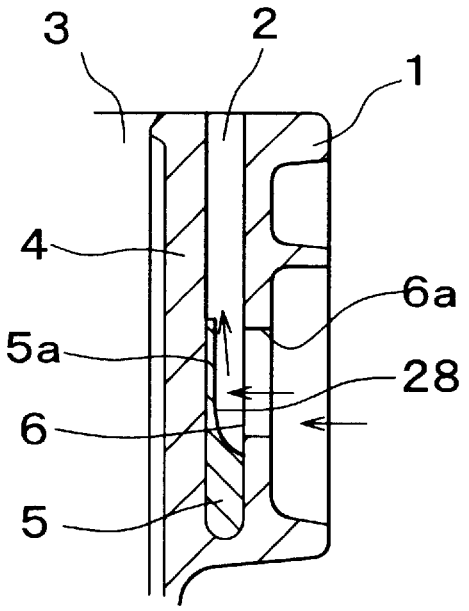
FIG. 49 is a sectional view of a cooling water inlet portion and its adjacent portion of a cylinder block cooling structure of Embodiment 57 of the invention.
Figure 50:
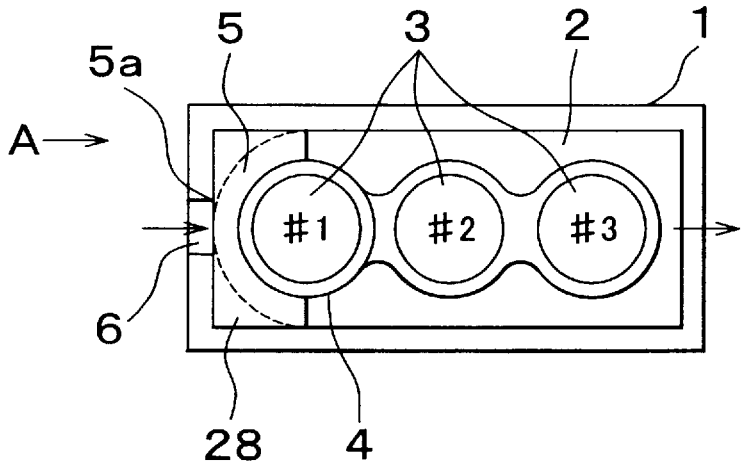
FIG. 50 is a plan view of the cylinder block cooling structure of Embodiment 57.
Figure 51:
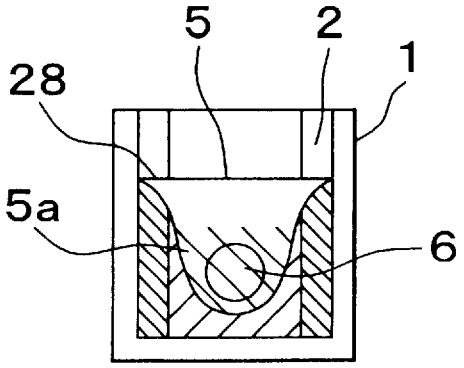
FIG. 51 is a view taken in a direction indicated by A in FIG. 50.

FIG. 50 shows a plan view of a cylinder block cooling structure in accordance with Embodiments 55 to 57 of the invention. FIG. 51 shows a section that includes a section taken on line VXI—VXI in FIG. 50. In the cylinder block cooling structures of Embodiments 55 to 57, a spacer portion 5*a* is disposed in the cooling water inlet portion 6 in a side portion of the cylinder block 1 as shown in FIGS. 47 to 51. The aforementioned flow resistance-reducing structure is formed by a structure in which a passage that does not cause a greater passage resistance than the conventional structures shown in FIGS. 63 to 70. More specifically, the flow resistance-reducing structure has at least one of the structures of Embodiments 55 to 57 described below.

Figure 47:
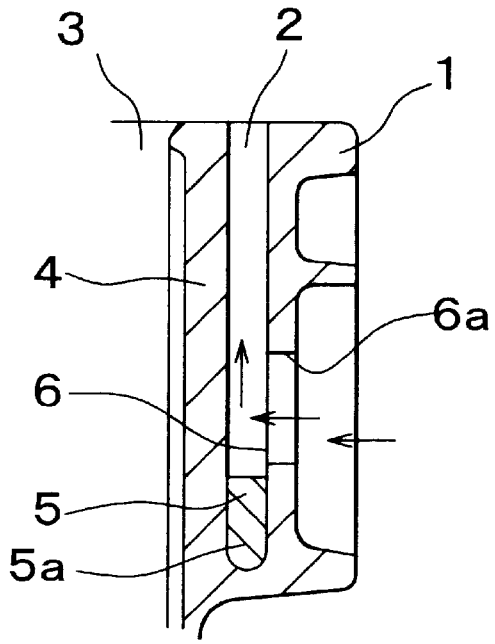
FIG. 47 is a sectional view of a cooling water inlet portion and its adjacent portion of a cylinder block cooling structure of Embodiment 55 of the invention.

Embodiment 55 (FIG. 47)

A portion corresponding to a cooling water inlet 6*a* is provided without a spacer.

Figure 48:
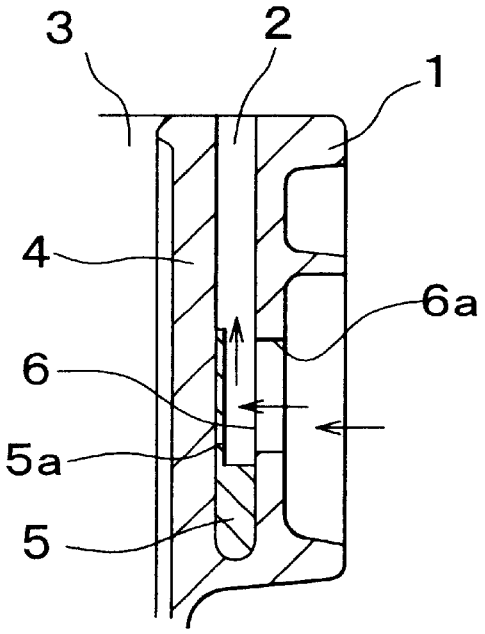
FIG. 48 is a sectional view of a cooling water inlet portion and its adjacent portion of a cylinder block cooling structure of Embodiment 56 of the invention.

Embodiment 56 (FIG. 48)

The thickness of the spacer 5 is made less in a portion corresponding to the cooling water inlet 6*a* than in the other portions of the spacer 5.

Embodiment 57 (FIGS. 49 to 51)

The spacer 5 is provided with a slope 28 or a curved surface for directing the flow diagonally upward, along an outer peripheral surface of the cylinder bore wall 4 from a portion facing the cooling water inlet 6*a*.

In the structures of Embodiments 55 and 56, the passage sectional area is expanded to reduce the water pass resistance. In the structure of Embodiment 57, the spacer 5 is provided with the slope 28 or the curved surface, thereby reducing the water pass resistance.

Figure 52:
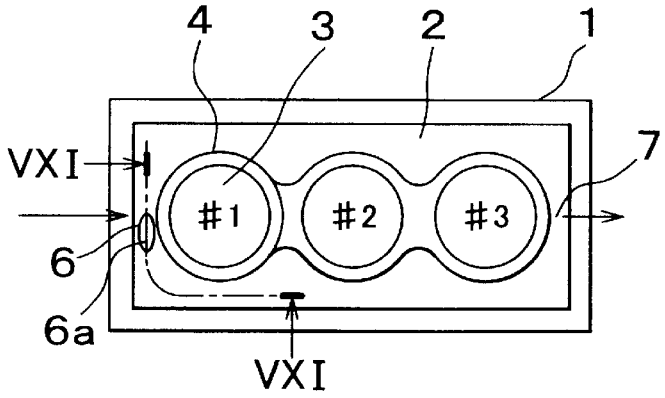
FIG. 52 is a plan view of a cylinder block cooling structure in accordance with Embodiments 58, 59 and 60.
Figure 53:
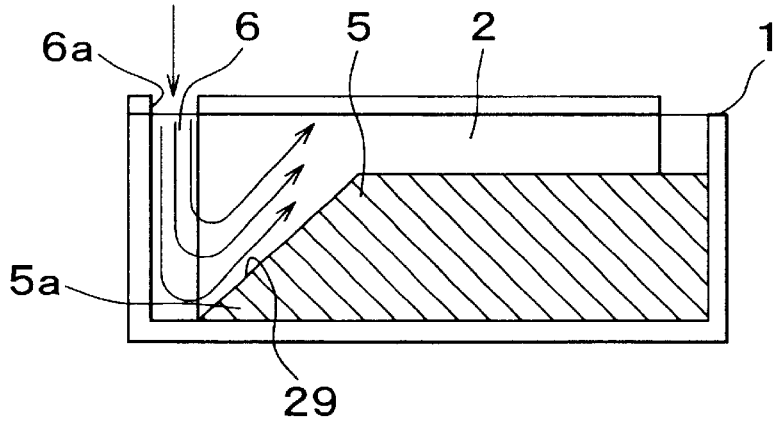
FIG. 53 is a sectional view of the cylinder block cooling structure of Embodiment 58 of the invention (including a section taken on line VXIII—VXIII in FIG. 52)
Figure 54:
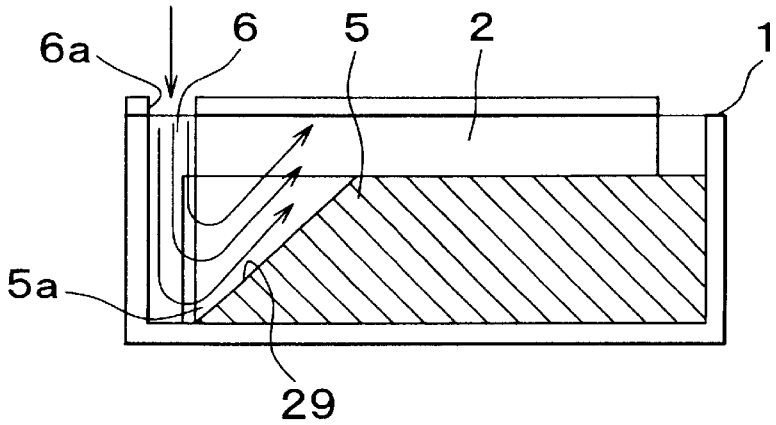
FIG. 54 is a sectional view of the cylinder block cooling structure of Embodiment 59 of the invention (including a section taken on line VXIII—VXIII in FIG. 52)

In cylinder block cooling structures in accordance with Embodiments 58 to 60 of the invention, a spacer portion 5*a* is disposed in a cooling water inlet portion 6 in an upper portion of the cylinder block 1 as shown in FIGS. 52 to 54. The flow resistance-reducing structure has at least one of the structures of Embodiments 58 to 60 described below.

Embodiment 58 (FIG. 53)

A portion corresponding to a cooling water inlet 6*a* is provided without a spacer.

Embodiment 59 (FIG. 54)

The spacer 5 is made thinner in a portion thereof extending from a portion facing a cooling water inlet 6*a* along the outer surface of the cylinder bore wall 4.

Figure 55:
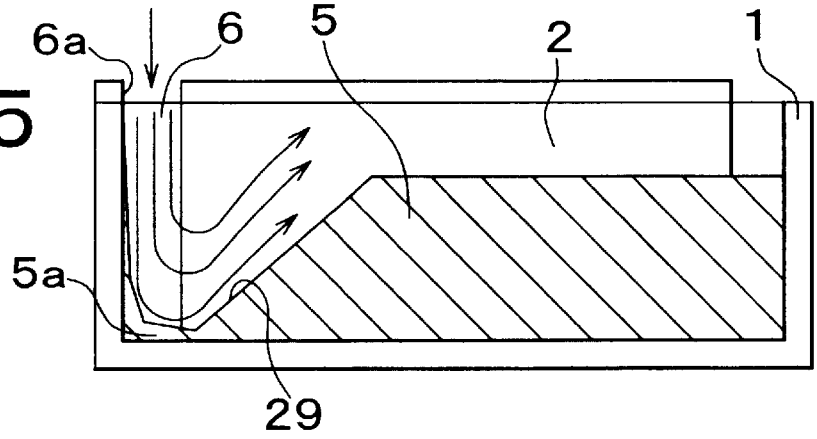
FIG. 55 is a sectional view of the cylinder block cooling structure of Embodiment 60 of the invention (including a section taken on line VXIII—VXIII in FIG. 52)
Figure 56:
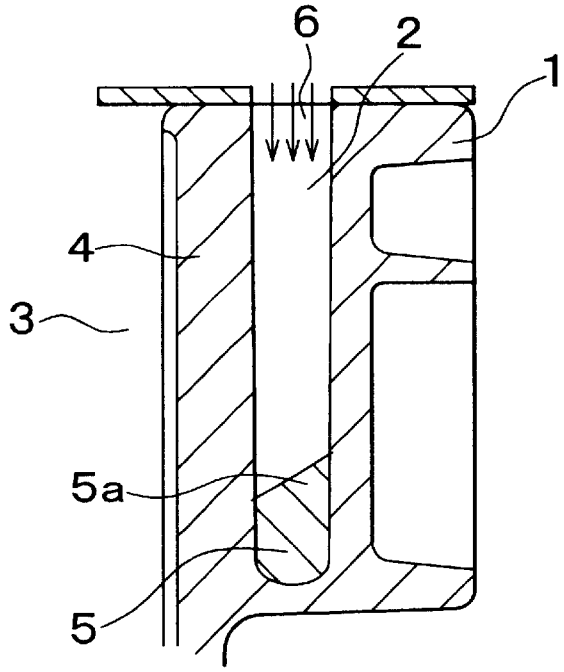
FIG. 56 is a sectional view of the cylinder block cooling structure of Embodiment 60 of the invention.

Embodiment 60 (FIGS. 55 and 56)

A portion of the spacer 5 extending from a portion facing the cooling water inlet 6*a* along the outer surface of the cylinder bore wall 4 is provided with a slope 29 or a curved surface for directing the flow diagonally upward.

In the structures of Embodiments 58 and 59, the passage sectional area is expanded to reduce the water pass resistance. In the structure of Embodiment 60, the spacer 5 is provided with the slope 29 or the curved surface, thereby reducing the passage resistance.

In cylinder block cooling structures in accordance with Embodiments 61, 62 of the invention, a spacer portion 5*b* is formed by a weir 5*b* disposed at a cooling water outlet portion 7 in an upper portion of the cylinder block 1. The flow resistance-reducing structure is formed by a structure in which no confluent portion exists in a cooling liquid passage, or a structure in which stagnation is reduced even though there is a confluent portion. More specifically, the flow resistance-reducing structure is formed by slopes 30 or curved surfaces that are formed on both sides of the weir 5*b* so as to turn the flow coming via both sides of the cylinder bore alignment into an upward or diagonally upward flow.

Figure 57:
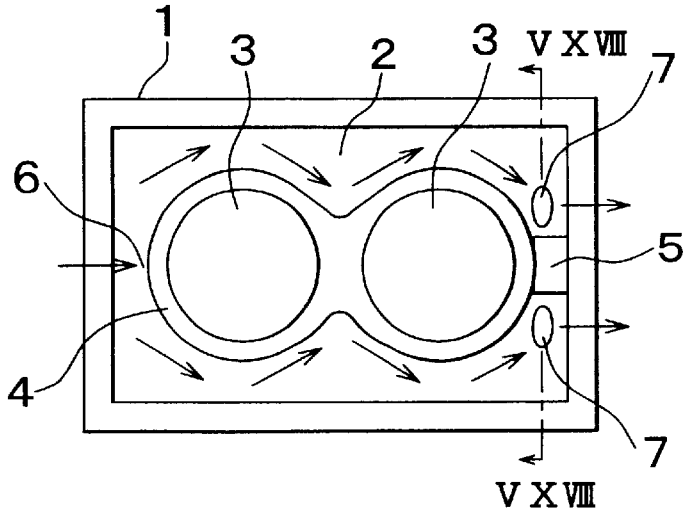
FIG. 57 is a plan view of a cylinder block cooling structure of Embodiment 61 of the invention.
Figure 58:
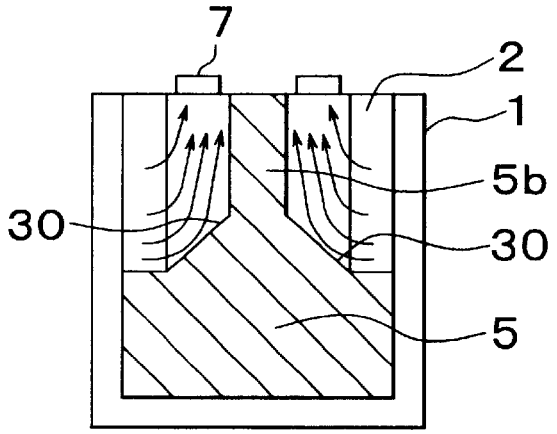
FIG. 58 is a sectional view of a cylinder block cooling structure of Embodiment 62 of the invention (section taken on line VXVIII—VXVIII in FIG. 57)
Figure 59:
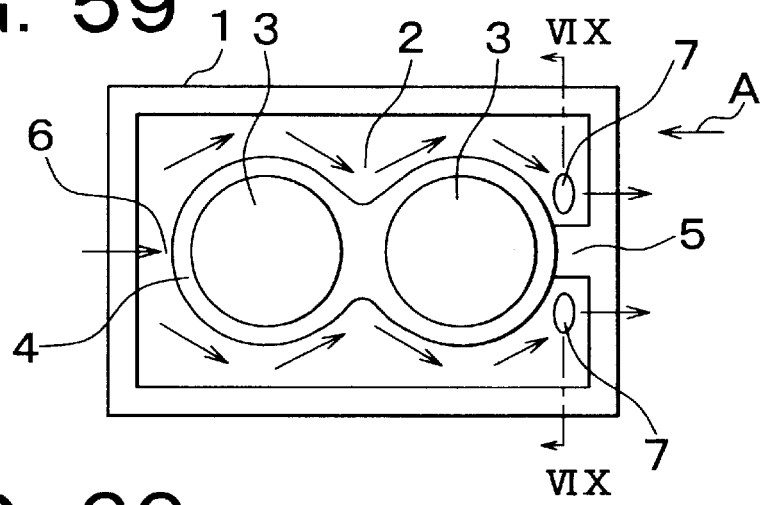
FIG. 59 is a plan view of a cylinder block cooling structure of Embodiment 63 of the invention.
Figure 60:
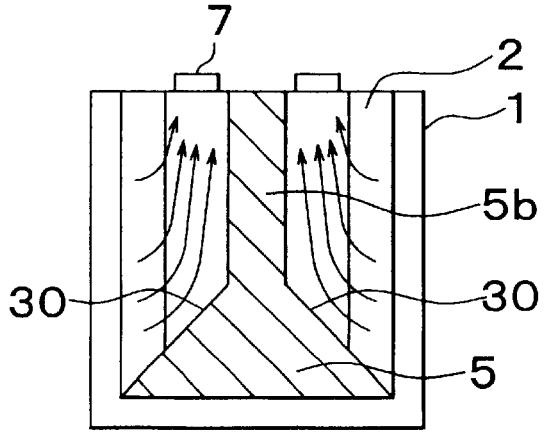
FIG. 60 is a sectional view of the cylinder block cooling structure of Embodiment 63 of the invention (section taken on line VIX—VIX in FIG. 59)

The weir 5*b* is formed as in Embodiment 61 or 62. FIGS. 57 and 59 show plan views of cylinder blocks. FIGS. 58 and 60 show a section taken on line VXVIII—VXVIII in FIG. 57 and a section taken on line VIX—VIX in FIG. 59, respectively.

Embodiment 61 (FIGS. 57 and 58)

A weir 5*b* is formed in a spacer 5 that is formed separately from the cylinder block 1.

Embodiment 62 (FIGS. 59 and 60)

A weir 5*b* is formed in a spacer 5 that is formed integrally with the cylinder block 1.

In a case where the weir 5*b* is formed integrally with the cylinder block 1, the casting mold structure becomes complicated, and the bore deformation deteriorates due to the bolt tightening force at the time of fastening the cylinder head. Therefore, it is desirable that the weir 5*b* be formed separately from the cylinder block 1.

In the structures of Embodiments 61 and 62, the weir 5*b* eliminates a confluent portion where streams coming via two sides of the cylinder bore arrangement meet and collide. Furthermore, the slopes 30 or curved surfaces formed on the weir 5*b* make smooth flow toward the outlet.

In Embodiments 55 to 62, the cooling water inflow resistance or outflow resistance with respect to the water jacket in the cylinder block is reduced. Therefore, the drive efficiency of the water pump rises, and the fuel economy improves. The inflow or outflow of cooling water with respect to the water jacket 2 becomes smooth and stable. Therefore, biased flow in the water jacket 2 in the cylinder block becomes less likely, and good effect is provided on the cooling uniformity with regard to the cylinder bore wall 4.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements.

What is claimed is:

1. A cooling structure of a cylinder block, comprising:

a water jacket continuously extending around a cylinder bore wall so as to convey a cooling medium, the cooling medium cooling the bore wall by flowing around the bore wall; and a spacer provided in the water jacket that sets a cooling characteristic of the water jacket, at least one of a configuration, a shape and a heat transfer rate of the spacer varying based on the position of the spacer in the water jacket, the at least one of the configuration and the cooling characteristic of the water jacket varying based on at least one of a variation in a temperature of a cylinder bore wall in a direction perpendicular to an axis of boreholes and a variation in a temperature of the cooling medium in the direction perpendicular to the axis of boreholes, passing around the bore wall.

perpendicular to the axis of boreholes, passing around the bore wall.

2. A cooling structure according to claim 1, wherein the spacer enhances a cooling capability with respect to an inter-cylinder bore wall portion more than a cooling capability with respect to a different site.

3. A cooling structure according to claim 1, wherein the spacer enhances a cooling capability with respect to an inter-cylinder bore wall portion more than a cooling capability with respect to a thrust/counterthrust side of the cylinder bore wall.

4. A cooling structure according to claim 1, wherein the spacer enhances a cooling capability with respect to an outer periphery of the cylinder bore wall disposed downstream in a cooling water passage more than a cooling capability with respect to an outer periphery of the cylinder bore wall disposed upstream of the cooling water passage.

5. A cooling structure according to claim 1, wherein the spacer enhances a cooling capability with respect to an upper portion of a cylinder bore wall outer periphery more than a cooling capability with respect to a lower portion of the cylinder bore wall outer periphery.

6. A cooling structure according to claim 1, wherein the spacer has a structure in which a load for inserting the spacer into the water jacket is reduced or eliminated.

7. A cooling structure according to claim 1, wherein the spacer has a structure in which the spacer is prevented from ascending in the water jacket.

8. A cooling structure according to claim 1, wherein the spacer has a structure for reducing a flow resistance, in a portion of the spacer disposed in a cooling water inlet portion or a cooling water outlet portion of the cylinder block.

9. A cooling structure according to claim 8, wherein the portion of the spacer is disposed in the cooling water inlet portion in a side portion of the cylinder block or in the cooling water inlet portion in an upper portion of the cylinder block, and wherein a thickness of a portion corresponding to the cooling water inlet portion is less than in the other portions of the spacer.

10. A cooling structure according to claim 8, wherein the portion of the spacer is formed by a weir disposed in the cooling water inlet portion in an upper portion of the cylinder block, and the structure for reducing the flow resistance includes a slope or a curved surface that is formed on each one of right and left side surfaces of the weir so as to turn a flow coming along two opposite sides of the cylinder bore into an upward or diagonally upward flow.

11. A cooling structure according to claim 1, wherein the spacer is formed separately from the cylinder block.

12. A cooling structure of a cylinder block, comprising:

a water jacket continuously extending around a cylinder bore wall so as to convey a cooling medium, the cooling medium cooling the bore wall by flowing around the bore wall;

a spacer disposed in the water jacket; and a mechanism that changes a position of cooling around an outer wall of the bore in accordance with a state of engine load, wherein when the engine load is low, the mechanism cools an upper portion of a cylinder bore-surrounding portion, and wherein when the engine load is high, the mechanism cools the upper portion of the cylinder bore-surrounding portion and a lower portion of the cylinder bore-surrounding portion.

13. A cooling structure according to claim 12, wherein the mechanism comprises at least a cooling water passage formed in the spacer positioned in the lower portion of the cylinder bore-surrounding portion, and the mechanism cools the lower portion of the cylinder bore-surrounding portion via a water.

14. A cooling structure according to claim 13, wherein the mechanism comprises a water amount controller that increases an amount of water in the cooling water passage of the spacer disposed in the lower portion of the cylinder bore-surrounding portion when the engine load is high.

15. A cooling structure according to claim 12, wherein the mechanism comprises a bimetal that is provided in the lower portion of the cylinder bore-surrounding portion so as to contact the cylinder bore wall when the engine load is high, and the bimetal includes a material that has a higher heat conductivity than a material of the cylinder block.

16. A cooling structure according to claim 12, wherein the mechanism comprises an air duct that is provided outside a cylinder block portion present in the lower portion of the cylinder bore-surrounding portion so as to cool the cylinder block portion, and the mechanism cools the cylinder block portion via an air when the engine load is high.

17. A cooling structure according to claim 12, wherein the mechanism comprises an engine oil passage in the lower portion of the cylinder bore-surrounding portion or comprises a nozzle for splashing an engine oil to an inner surface of the cylinder bore, and wherein when the engine load is high, the mechanism cools the lower portion of the cylinder bore-surrounding portion via the engine oil by passing the engine oil through the engine oil passage or ejecting the engine oil from the nozzle.

18. A cooling structure according to claim 12, wherein the spacer has a structure for reducing a flow resistance, in a portion of the spacer disposed in a cooling water inlet portion or a cooling water outlet portion of the cylinder block.

19. A cooling structure according to claim 18, wherein the portion of the spacer is disposed in the cooling water inlet portion in a side portion of the cylinder block or in the cooling water inlet portion in an upper portion of the cylinder block, and wherein a thickness of a portion corresponding to the cooling water inlet portion is less than in the other portions of the spacer.

20. A cooling structure according to claim 18, wherein the portion of the spacer is formed by a weir disposed in the cooling water outlet portion in an upper portion of the cylinder block, and the structure for reducing the flow resistance includes a slope or a curved surface that is formed on each one of right and left side surfaces of the weir so as to turn a flow coming along two opposite sides of the cylinder bore into an upward or diagonally upward flow.

21. A cooling structure according to claim 12, wherein the spacer is formed separately from the cylinder block.

* * * * *